US007395634B2

(12) United States Patent
Anderson et al.

(10) Patent No.: US 7,395,634 B2
(45) Date of Patent: Jul. 8, 2008

(54) PLASTIC EXPANDABLE UTILITY SHED

(75) Inventors: Torrence Anderson, Overland Park, KS (US); Brian Moon, DeKalb, IL (US); Jed C. Richardson, Batavia, IL (US)

(73) Assignee: Suncast Corporation, Batavia, IL (US)

( * ) Notice: Subject to any disclaimer, the term of this patent is extended or adjusted under 35 U.S.C. 154(b) by 696 days.

(21) Appl. No.: 10/674,103

(22) Filed: Sep. 29, 2003

(65) Prior Publication Data

US 2004/0187400 A1 Sep. 30, 2004

Related U.S. Application Data

(63) Continuation-in-part of application No. 10/404,281, filed on Mar. 31, 2003, now Pat. No. 6,892,497.

(60) Provisional application No. 60/469,440, filed on May 12, 2003.

(51) Int. Cl.

| | |
|---|---|
| ***E04H 1/00*** | (2006.01) |
| ***E04B 1/00*** | (2006.01) |
| ***E04B 5/00*** | (2006.01) |
| ***E04B 7/00*** | (2006.01) |
| ***E04B 2/08*** | (2006.01) |

(52) U.S. Cl. ..... 52/79.1; 52/264; 52/284; 52/589.1; 52/270

(58) Field of Classification Search ..... 52/79.1, 52/79.5, 264, 284, 585.1, 589.1, 270; 403/DIG. 10, 403/150

See application file for complete search history.

(56) References Cited

U.S. PATENT DOCUMENTS

| | | | | | |
|---|---|---|---|---|---|
| 1,936,571 | A | * | 11/1933 | Bumann | 446/123 |
| 3,866,381 | A | | 2/1975 | Eschbach et al. | |
| 4,557,091 | A | | 12/1985 | Auer | |
| 4,570,392 | A | * | 2/1986 | Oltman et al. | 52/64 |
| 5,036,634 | A | | 8/1991 | Lessard et al. | |
| D371,208 | S | | 6/1996 | DeZen | |
| 5,544,870 | A | * | 8/1996 | Kelley et al. | 256/26 |
| 5,619,826 | A | * | 4/1997 | Wu | 52/35 |
| 5,682,622 | A | * | 11/1997 | Tagg | 4/449 |
| 5,706,613 | A | * | 1/1998 | Drake et al. | 52/79.1 |
| 5,823,700 | A | * | 10/1998 | Poworoznek | 403/245 |
| 6,115,885 | A | * | 9/2000 | Strickler et al. | 16/266 |
| 6,115,971 | A | * | 9/2000 | Loebertmann et al. | 52/79.1 |
| 6,250,022 | B1 | * | 6/2001 | Paz et al. | 52/79.5 |
| 6,250,032 | B1 | * | 6/2001 | Davis et al. | 52/239 |
| 6,412,243 | B1 | * | 7/2002 | Sutelan | 52/309.7 |
| 6,418,672 | B1 | * | 7/2002 | Hampel | 52/79.1 |

(Continued)

FOREIGN PATENT DOCUMENTS

| | | | |
|---|---|---|---|
| EP | 346902 | A * | 12/1989 |

*Primary Examiner*—Jeanette Chapman
*Assistant Examiner*—Elizabeth A Plummer
(74) *Attorney, Agent, or Firm*—McHale & Slavin, P.A.

(57) ABSTRACT

The present invention provides a system, or kit, of injection molded panels having integrated connectors which combine to form an enclosure, commonly in the form of a utility shed. The panels are formed of injection molded plastic to interlock with one another without the need for separate I-beam connectors. The ends of the wall panels have cavities to accept both roof and floor outwardly projecting locking posts for interlocking cooperative engagement which serve to rigidly connect the components together. The symmetry of the wall, roof, floor and door components also minimizes component shapes and simplifies enclosure construction.

43 Claims, 22 Drawing Sheets

U.S. PATENT DOCUMENTS 6,581,337 B1 * 6/2003 Skov et al. ..... 52/79.5
6,604,328 B1 * 8/2003 Paddock ..... 52/93.1
6,701,678 B1 * 3/2004 Skov et al. ..... 52/79.9
6,796,087 B1 * 9/2004 Greene ..... 52/32
2003/0140573 A1 * 7/2003 Marcinkowski et al. ..... 52/79.5
2005/0120641 A1 * 6/2005 Whitehead et al. ..... 52/79.1
2005/0223652 A1 * 10/2005 Mower et al. ..... 52/79.1

* cited by examiner

PLASTIC EXPANDABLE UTILITY SHED

REFERENCE TO RELATED APPLICATIONS

This application is a continuation-in-part of Ser. No. 10/404,281, filed Mar. 31, 2003, now U.S. Pat. No. 6,892,497 the contents of which are herein incorporated by reference in their entirety. This application is also a continuation of provisional application 60/469,440, filed May 12, 2003, the contents of which are herein incorporated by reference in their entirety.

FIELD OF THE INVENTION

This invention relates generally to a large enclosure constructed of plastic structural panels. More specifically, the present invention relates to a modular construction system utilizing injection molded plastic structural panels having integrated connectors to construct various larger sized enclosures using the same components.

BACKGROUND INFORMATION

Utility sheds are a necessity for lawn and garden care, as well as general all-around home storage space. Typically, items such as garden tractors, snow blowers, tillers, ATVs, motorcycles and the like consume a great deal of the garage floor space available, forcing the homeowner to park his automobile outside.

The prior art has proposed a number of different panel systems, or kits, comprising blow molded or extruded panels and connector members for forming a wide variety of smaller sized storage structures. These structures are generally suitable to store hand tools and smaller lawn equipment. Typically, such systems require extruded metal or plastic connector members having a specific cross-sectional geometry that facilitate an engagement between such members and one or more blow molded plastic panels having a complimentary edge configuration. Due to the nature of the manufacturing process, blow molded plastic components cannot be formed with the intricate shapes and/or sharp corners required for integrated connectors. In addition, blow molded plastic components are hollow and cannot be formed with the integral strengthening ribs and gussets possible with injection molding.

A particularly common structure for the connector members is the I-beam cross section. The I-beam defines free edge portions of the connector member which fit within appropriately dimensioned and located slots in the panel members. U.S. Pat. No. D-371,208 teaches a corner extrusion for a building sidewall that is representative of the state of the art I-beam connector members. The I-beam sides of the connector engage with the peripheral edge channels of a respective wall panel and thereby serve to join such panels together at right angles. Straight or in-line versions of the connector members are also included in the kits to join panels in a coplanar relationship to create walls of varying length.

Extruded components generally require hollow longitudinal conduits for strength. Due to the nature of the manufacturing process the conduits are difficult to extrude in long sections for structural panels. Thus, they require connectors to achieve adequate height for utility shed walls. A common structure for connecting extruded members has a center I-beam with upper and lower protrusions for engaging the conduits. However, wall panels utilizing connectors are vulnerable to buckling under loads and may have an aesthetically unpleasing appearance. Moreover, roof loads from snow and the like may cause such walls to bow outwardly due to the clearances required between the connectors and the internal bores of the conduits. U.S. Pat. No. 6,250,022 discloses an extendable shed utilizing side wall connector members representing the state of the art. The connectors have a center strip with hollow protrusions extending from its upper and lower surfaces along its length. The protrusions being situated to slidably engage the conduits located in the side panel sections to create the height needed for utility shed walls.

The aforementioned systems can also incorporate roof and floor panels to form a freestanding enclosed structure such as a small utility shed. U.S. Pat. Nos. 3,866,381; 5,036,634; and 4,557,091 disclose various systems having interfitting panel and connector components. Such prior art systems, while working well, have not met all of the needs of consumers to provide the structural integrity required to construct larger sized structures. Larger structures must perform differently than small structures. Larger structures require constant ventilation in order to control moisture within the building. Large structures must also withstand increased wind and snow loads when compared to smaller structures. Paramount to achieving these needs is a panel system which eliminates the need for extruded connectors to create enclosure walls which resist panel separation, buckling, racking, and a roof system which allows ventilation while preventing weather infiltration. A further problem is that the wall formed by the panels must tie into the roof and floor in such a way as to unify the entire enclosure. Also, from a structural standpoint, the enclosure should include components capable of withstanding the increased wind, snow, and storage loads required by larger structures. From a convenience standpoint, a door must be present which can be easily installed after assembly of the wall and roof components, is compatible with the sidewalls, and which provides dependable pivoting door access to the enclosure. Also from a convenience standpoint, the structure should allow natural as well as artificial lighting and electrical outlets.

There are also commercial considerations that must be satisfied by any viable enclosure system or kit; considerations which are not entirely satisfied by state of the art products. The enclosure must be formed of relatively few component parts that are inexpensive to manufacture by conventional techniques. The enclosure must also be capable of being packaged and shipped in a knocked-down state. In addition, the system must be modular and facilitate the creation of a family of enclosures that vary in size but which share common, interchangeable components.

Finally, there are ergonomic needs that an enclosure system must satisfy in order to achieve acceptance by the end user. The system must be easily and quickly assembled using minimal hardware and requiring a minimal number of tools. Further, the system must not require excessive strength to assemble or include heavy component parts. Moreover, the system must assemble together in such a way so as not to detract from the internal storage volume of the resulting enclosure or otherwise detract from the internal storage volume of the resulting enclosure or otherwise negatively affect the utility of the structure.

BRIEF DESCRIPTION OF THE INVENTION

The present invention provides a system, or kit, of injection molded panels having integrated connectors which combine to form an enclosure, commonly in the form of a large utility shed. The corner pillars, roof, wall and floor panels are formed of injection molded plastic to interlock with one another without the need for separate I-beam connectors. The ends of the pillars and wall panels have receptacles to accept both roof and floor bosses for interlocking cooperative engagement to rigidly connect the components together.

The system incorporates a minimum number of components to construct a large heavy duty enclosure by integrally forming connectors into injection molded panels. This minimizes the need for separate extruded or molded connectors to assemble the enclosure. The symmetry of the corner pillars, wall, roof, floor and door components also minimizes component shapes and simplifies enclosure construction. The heavy duty interlocking construction of the corner pillars and the roof headers create a structural frame that allows construction of larger enclosures. Injection molding the wall panels allow them to be formed with adequate height for a large walk-in enclosure, eliminating the need for stacking panels to achieve such a height. Injection molding also allows the panels to be formed with integral cross-bracing, ribs, and gussets for increased rigidity when compared to blow molded or extruded panels.

In one embodiment, the enclosure system utilizes interlocking corner pillars, roof headers, and floor panels to create a structural frame. Two types of wall panel construction are integrated into the structural frame: the first being utilized for the side walls, and the second being used for the rear wall and the door assembly. The side walls are constructed to allow clear or opaque portions for natural lighting and also include provisions for standard electrical current hookup. The embodiment also incorporates a vented gabled roof assembly with anti-lift wind strapping and steel reinforcement. The system further includes a door assembly which slides into place after the walls and roof have been fully assembled. The floor of the system is constructed to allow optional floor joists to be added to the plastic floor panels to further increase the structural integrity of the enclosure. The same components are used to create sheds of varying size, and the assembly of the system requires minimal hardware and a minimum number of hand tools.

Accordingly, it is an objective of the present invention to provide a plastic structural frame and panel system having integrated connectors for creating larger enclosures of varying dimension using common components.

A further objective is to provide a structural frame and panel system with integrated connectors which accommodates injection molding plastic formation of the panel components for increased structural integrity.

Yet a further objective is to provide a structural frame and panel system enclosure which utilizes structural L-shaped corner pillars for increased enclosure rigidity.

Another objective is to provide a structural frame and panel system enclosure constructed with side panels having interlocking ridge and groove edges to increase rigidity and prevent panel bowing or separation.

Yet another objective is to provide a structural frame and panel system enclosure which reduces the number of components required to assemble an enclosure and simplifies construction.

Still yet another objective is to provide a structural frame and panel system enclosure constructed and arranged with panels that allow wood and/or steel supports to be easily incorporated therein.

An even further objective is to provide a structural frame and panel system enclosure constructed and arranged to allow airflow through the enclosure while preventing weather related moisture from entering the enclosure.

Yet a further objective is to provide a structural frame and panel system enclosure which may be optionally configured with translucent windows thereby allowing natural light to enter the enclosure.

Still yet a further objective is to provide a structural frame and panel system enclosure that is constructed and arranged for connection to standard electrical power.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
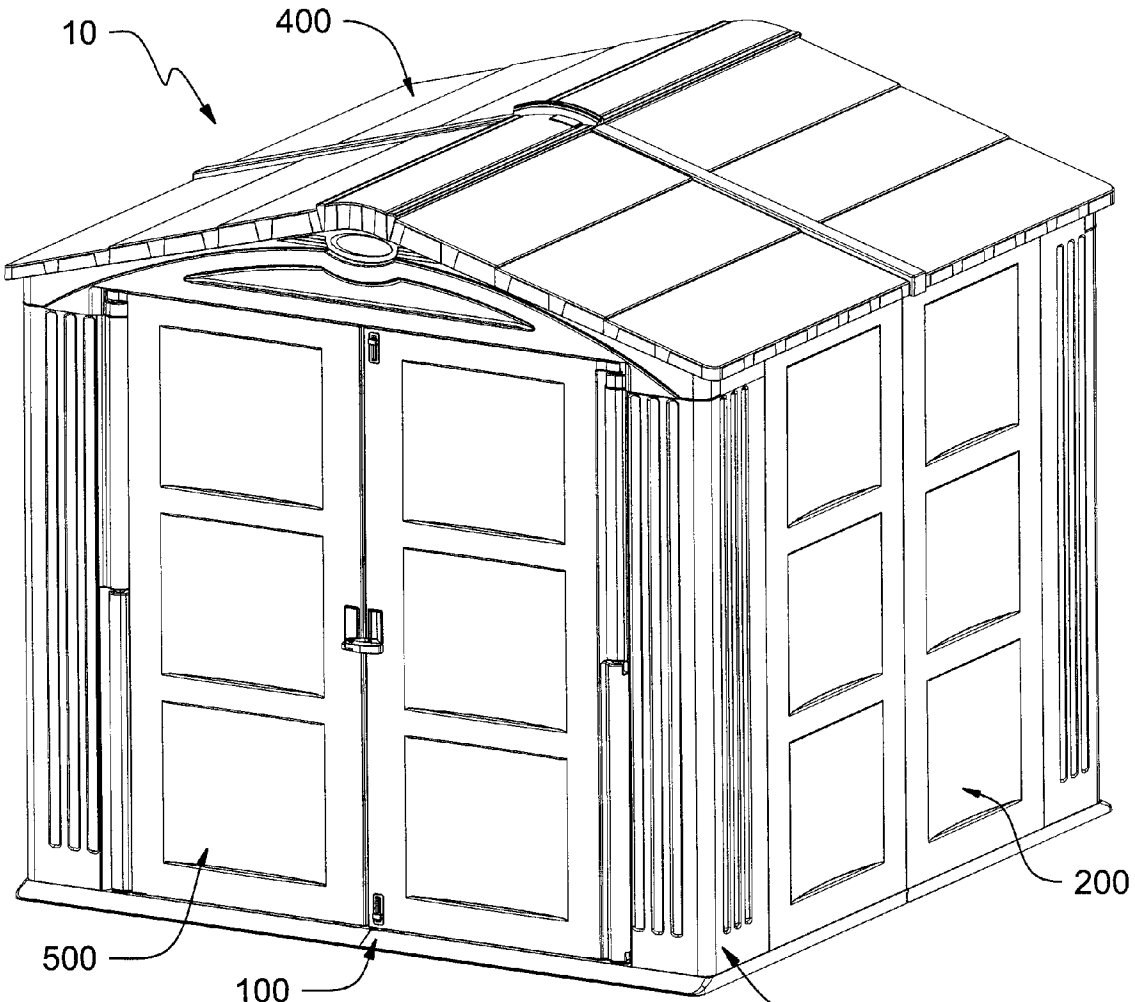
FIG. 1 is a perspective view of an enclosure constructed using the instant enclosure system.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
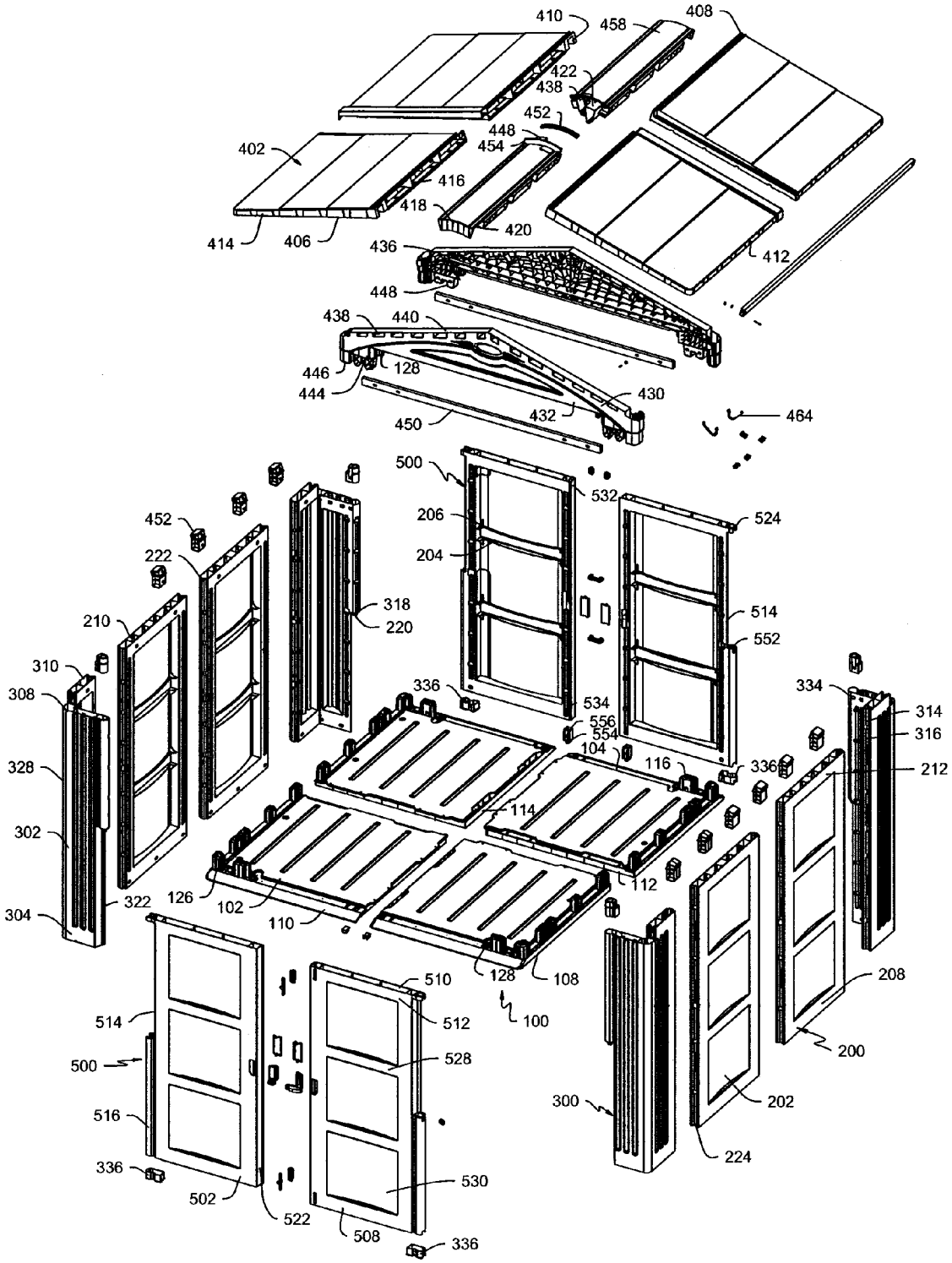
FIG. 2 is an exploded view of the enclosure shown in FIG. 1.
Figure 3:
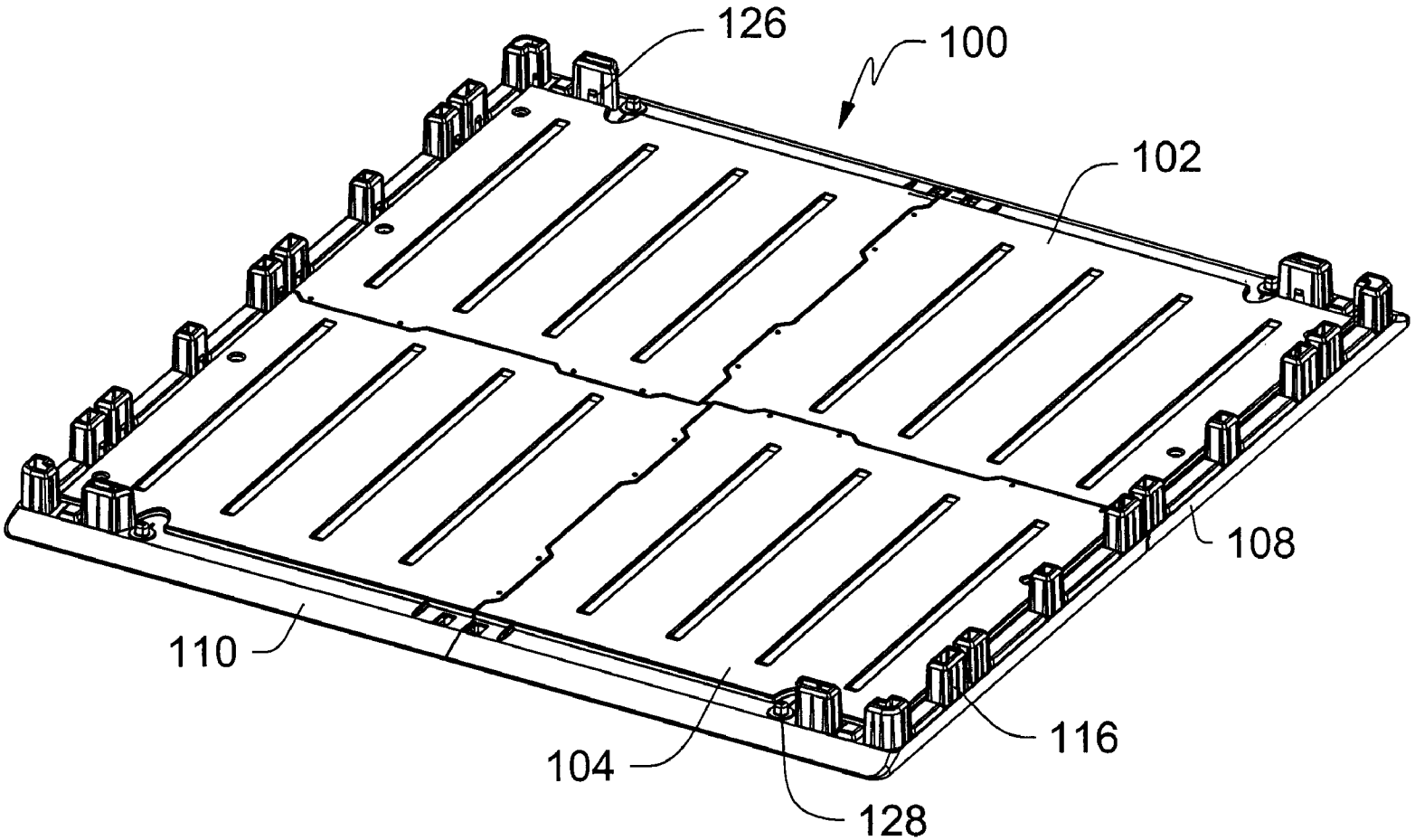
FIG. 3 is a perspective view of one embodiment of the floor assembly utilized in the instant invention.
Figure 4:
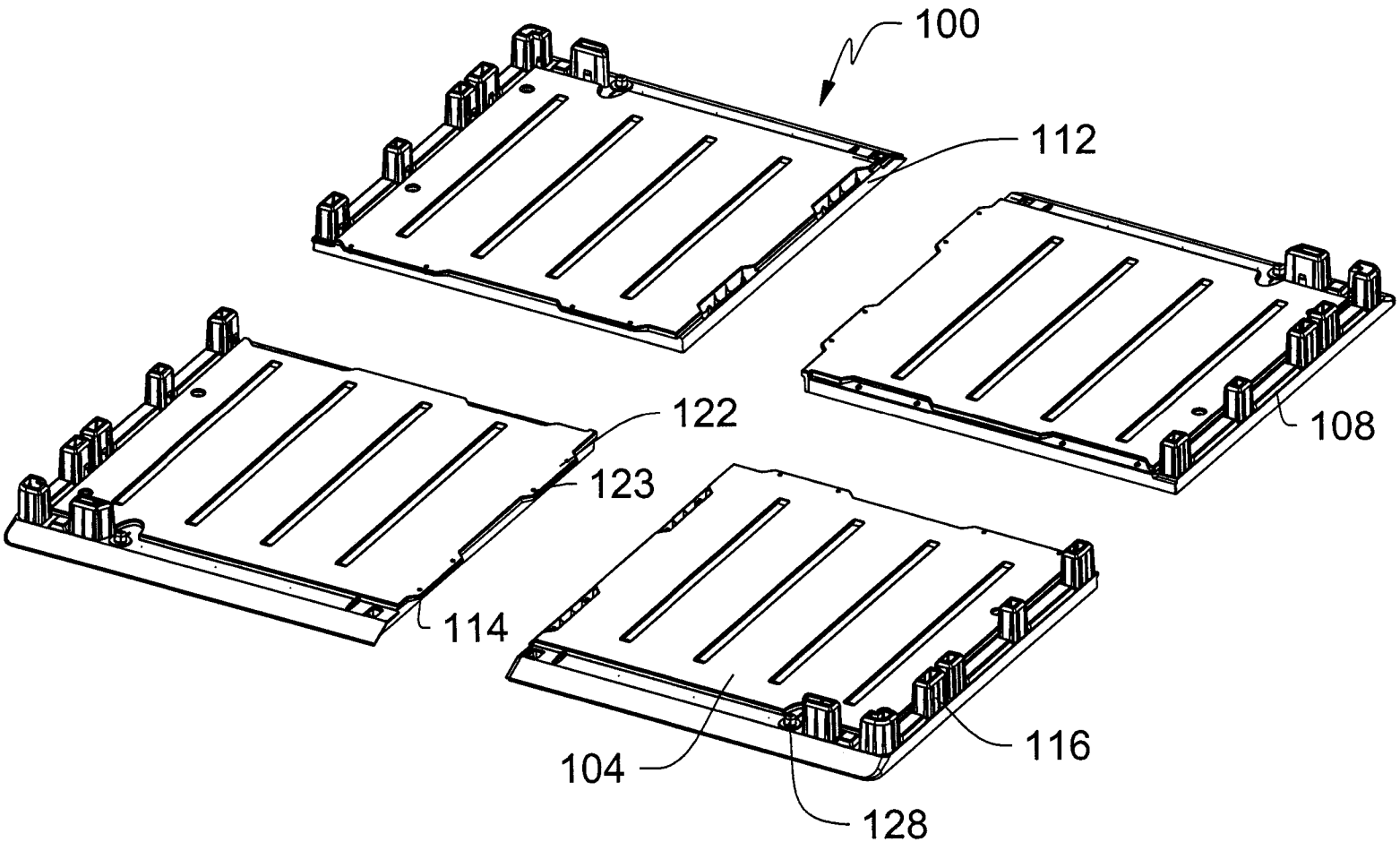
FIG. 4 is an exploded perspective view of the floor assembly shown in FIG. 3.
Figure 5:
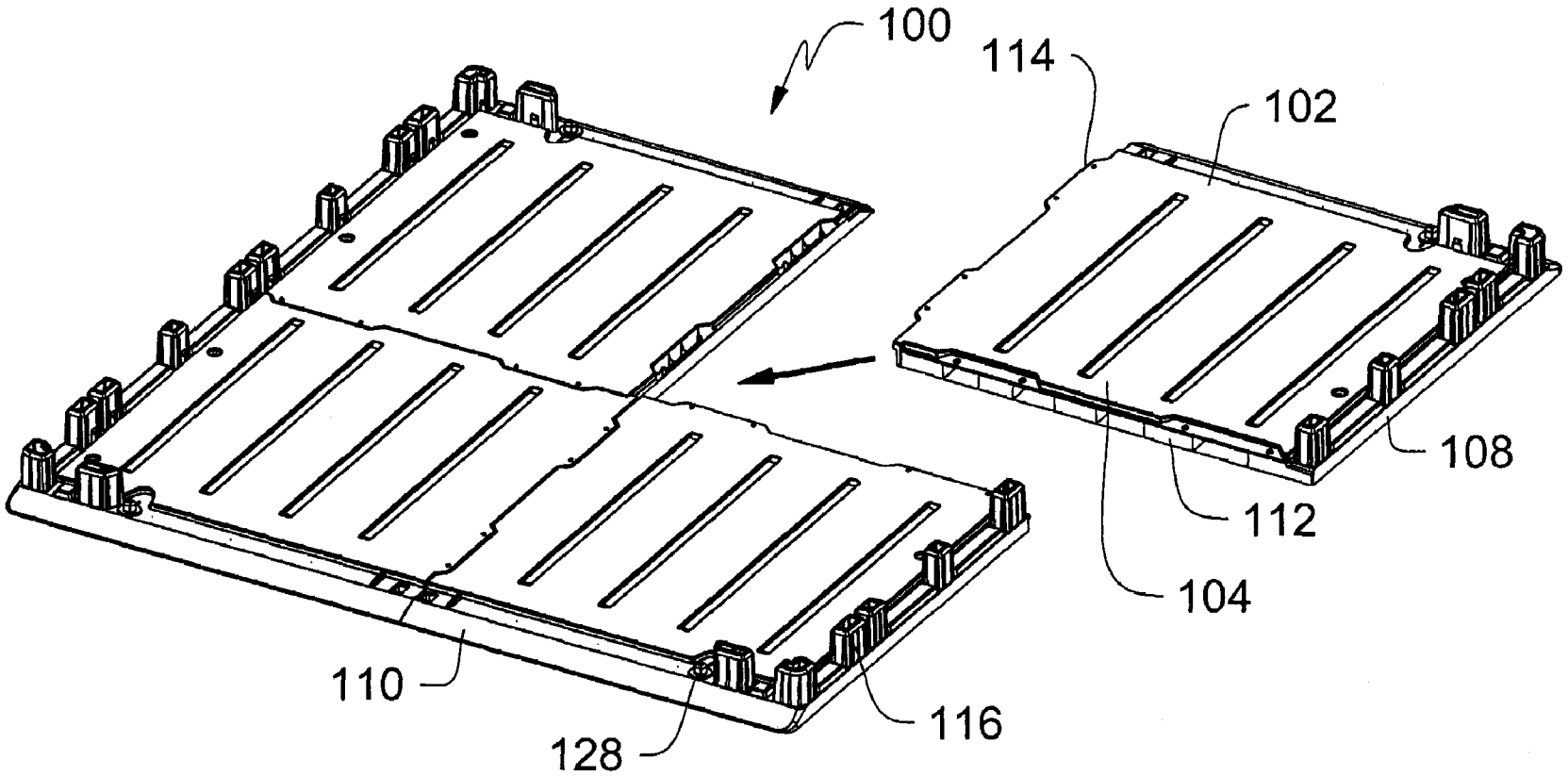
FIG. 5 is a perspective view of the floor assembly illustrating the sliding engagement of the floor panels.
Figure 6:
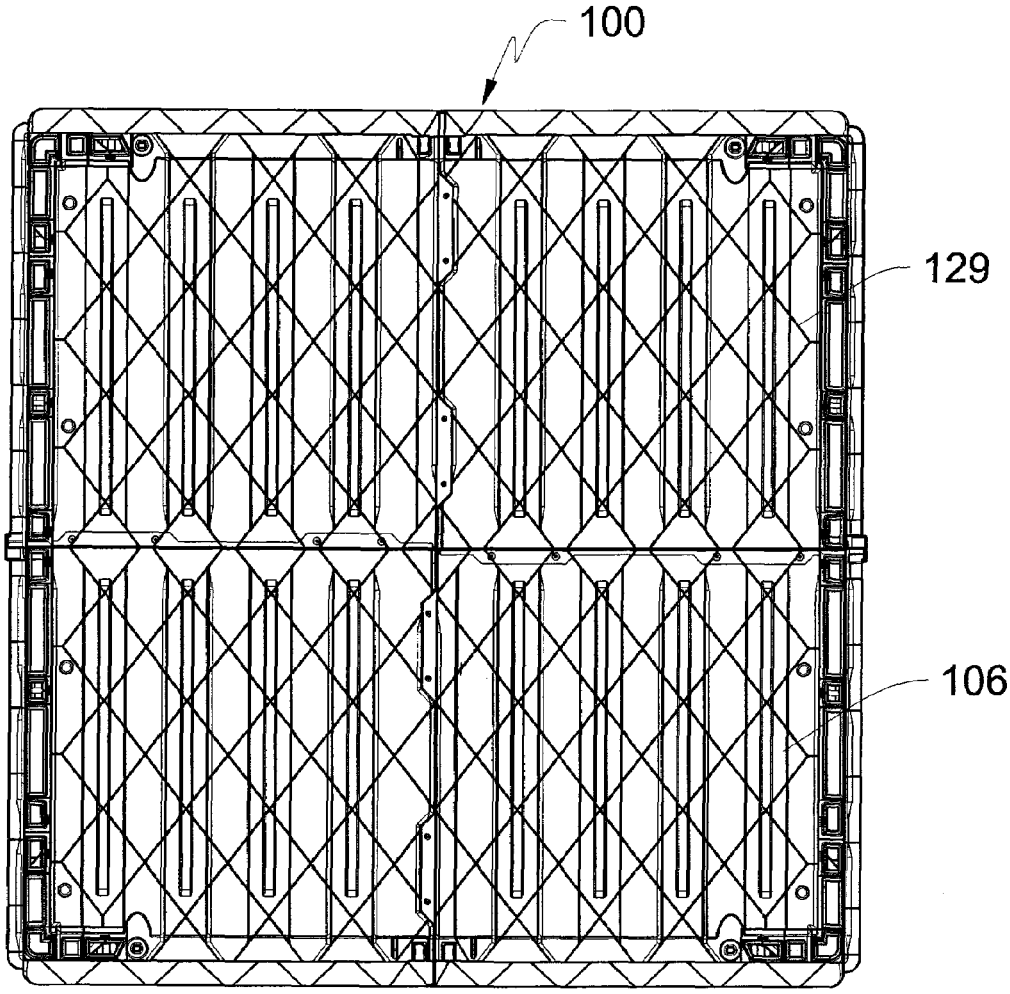
FIG. 6 is a bottom view of the floor assembly illustrating the cross-bracing.

FIGS. 1 and 2 which are now referenced show an isometric and exploded view of the heavy duty structural frame and panel system enclosure, generally referenced as 10, according to a preferred embodiment of the present invention. The enclosure is made up of a floor assembly 100, left and right side wall assemblies 200, corner pillars 300, roof assembly 400, rear wall and door assemblies 500. In the preferred embodiment, the panels comprising the assemblies are formed of but not limited to a suitable plastic such as polystyrene or polyethylene, through the process of long core injection molding. The result is that the panels comprising the floor 100, pillars 300, side walls 200, roof 400, rear wall and doors 500 of the enclosure 10 are formed as unitary panels with integral connectors, and cross bracing. Strengthening ribs 204 and gussets 206 are formed within the inner surfaces of the wall panels 202-502 in order to enhance rigidity of the panels while leaving the external surface in a generally smooth condition for aesthetic purposes, as shown in FIG. 1. The injection molded construction is utilized for the floor assembly 100, left and right wall assemblies 200, the corner pillars 300, roof assembly 400, and rear wall and door assemblies 500 using a minimal number of components.

Referring to FIGS. 3-6, the enclosure includes two pair of like-constructed floor panels 102. Each panel has a top surface 104, bottom surface 106, a closed edge 108, a ramp edge 110, a first locking edge 112, and a second locking edge 114. Adjacent to the closed edge 108 and the ramp edge 110 is a means of attaching the floor assembly to the wall assemblies illustrated herein as a plurality of bosses 116 extending upwardly from the top surface 104. The bosses 116 are constructed and arranged to cooperate with sockets 210, 310 and 510 located at each longitudinal end of the structural wall panels 202, 502 and the structural L-shaped pillars 302. Adjacent to each of the ramp edges 110 is a pair of generally cylindrical hinge pins 128 extending upwardly. The hinge pins 128 cooperate with the wall panels 502 to allow pivotal movement. A series of spaced apart tubes 118 extend through each floor panel 102 under the top surface 104 and between the locking edge 112 and the ramp edge 110. The tubes 118 are constructed and arranged to add increased weight capacity and stability to the enclosure 10. Along the locking edges 112, 114 of each floor panel 102 is a series of spaced apart fingers 122 and recesses 124 for attaching the panels together into a floor assembly 100, each of the fingers being provided with at least one countersank aperture 123 for receiving a fastener (not shown). The fingers 122 and recesses 124 are constructed and arranged so that the fingers 122 overlap and mateably engage the recesses 124. The fasteners secure the panels together in an inter-fitting engagement with their respective top surfaces 104 in a coplanar arrangement. The bottom surface 106 (FIG. 6) illustrates the cross-bracing 129 facilitated by injection molding of panels. Injection molding offers significant strength and stability advantages over blow-molding as utilized in the prior art. In this manner, the enclosure of the instant invention is capable of handling a significant amount of weight as compared to blow molded or extruded enclosures.

Figure 7:
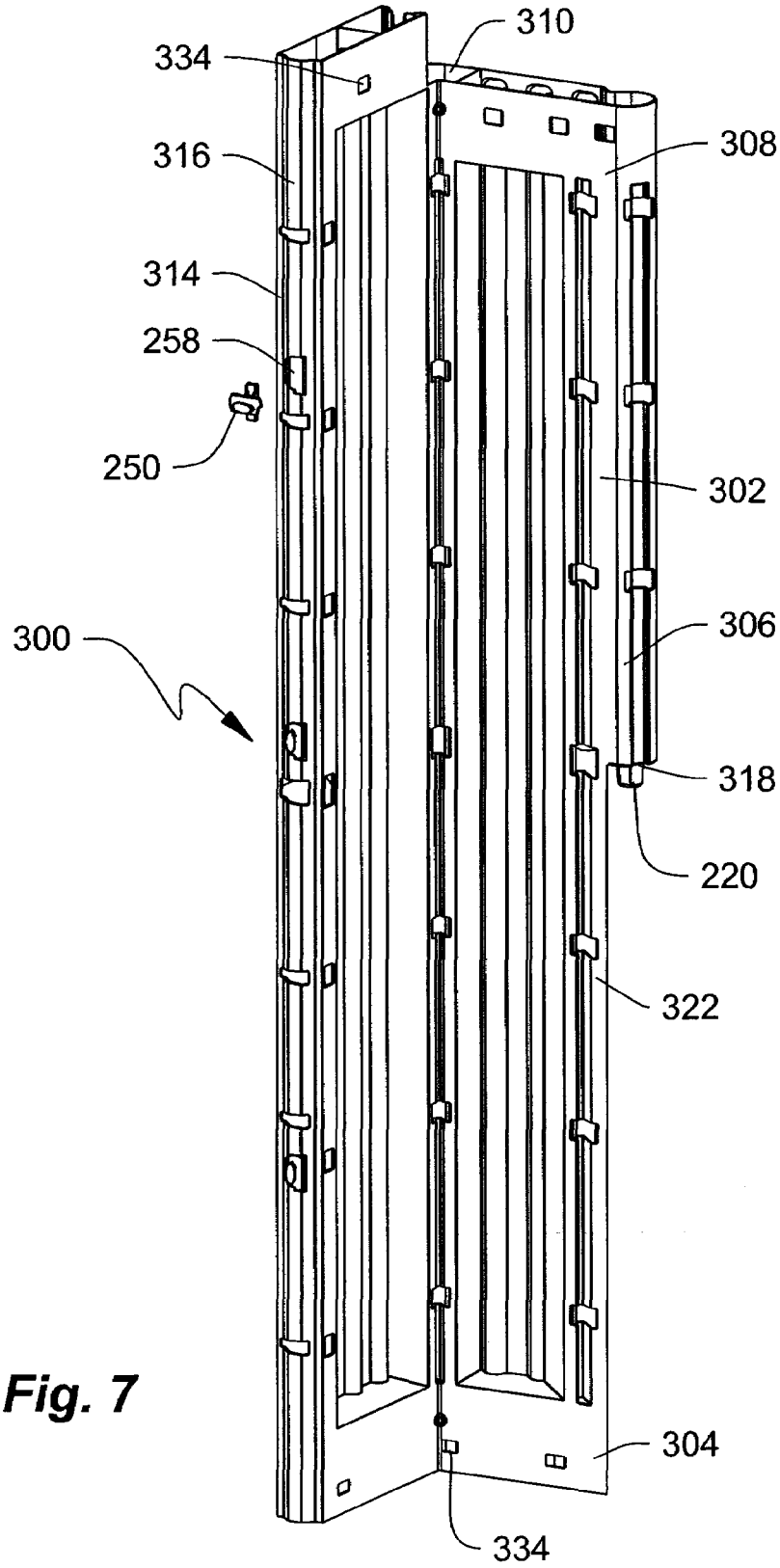
FIG. 7 is a perspective view illustrating one of the corner pillars utilized in the instant invention.

Referring to FIG. 7 a structural corner pillar 302 is shown. The corner pillar 302 constitutes one of a plurality of like-configured structural pillars in the system used to add significant strength and rigidity to the enclosure 10. The corner pillars 302 are generally L-shaped having one leg extending at least partially along the front or rear wall of the enclosure and one leg extending at least partially along a side wall of the enclosure. The structural corner pillars 302 are each configured having a first longitudinal end 304 and a second longitudinal end 308 each including an integrally formed attachment means illustrated as a plurality of sockets 310. The sockets are generally constructed and arranged to cooperate with either a floor assembly 100 or a roof assembly 400 in a generally perpendicular relationship. To facilitate mechanical connection with other structural panel members 202 in a co-planar relationship the pillars are provided a first horizontal edge 314 constructed with an attachment means illustrated as a ridge or groove portion 316 extending from about the first longitudinal end 304 to about the second longitudinal end 308 of the edge 314. The ridge or groove 316 is arranged to cooperate with a side-panel member 202 having a complimentary ridge or groove in a interlocking coplanar relationship. To facilitate mechanical connection with rear wall panel or door panel members 502 the second horizontal edge 322 of the corner pillars 302 are constructed with a semi-circular conduit 306 extending from about the second longitudinal end 308 to about the middle portion of the edge. Centrally located within the semi-circular conduit 306 is a generally circular aperture 318 for accepting a dowel pin 220. The conduits 306 are arranged to cooperate with other panel members having a complimentary semi-circular conduit in a co-planar, perpendicular, or pivotable relationship. The outer surface 328 (FIG. 1) of the corner pillars 302 are constructed generally smooth having a plurality of inwardly bowed surfaces 324 for added strength and aesthetic appearance. The inwardly bowed surfaces 324 increase the structural integrity of the enclosure 10 by preventing the corner pillars 302 from bowing or bending inwardly or outwardly, and thus, adversely affecting the appearance or operation of the enclosure 10.

The L-shaped corner pillars 302 are attached to the interconnected floor-panels 102 by sliding the first longitudinal end 304 over a plurality of the bosses 116 extending outwardly from the floor panels 102. The pockets 310 in each end of the panels 302 correspond in shape and size to that of the bosses 116 and spring tabs 126 (FIG. 3) integrally formed into the bosses 116 align with apertures 334 in the pockets 310 to engage the side wall panel 302. The result is a positive mechanical connection between the corner pillars 302 and the floor assembly 100.

Figure 8:
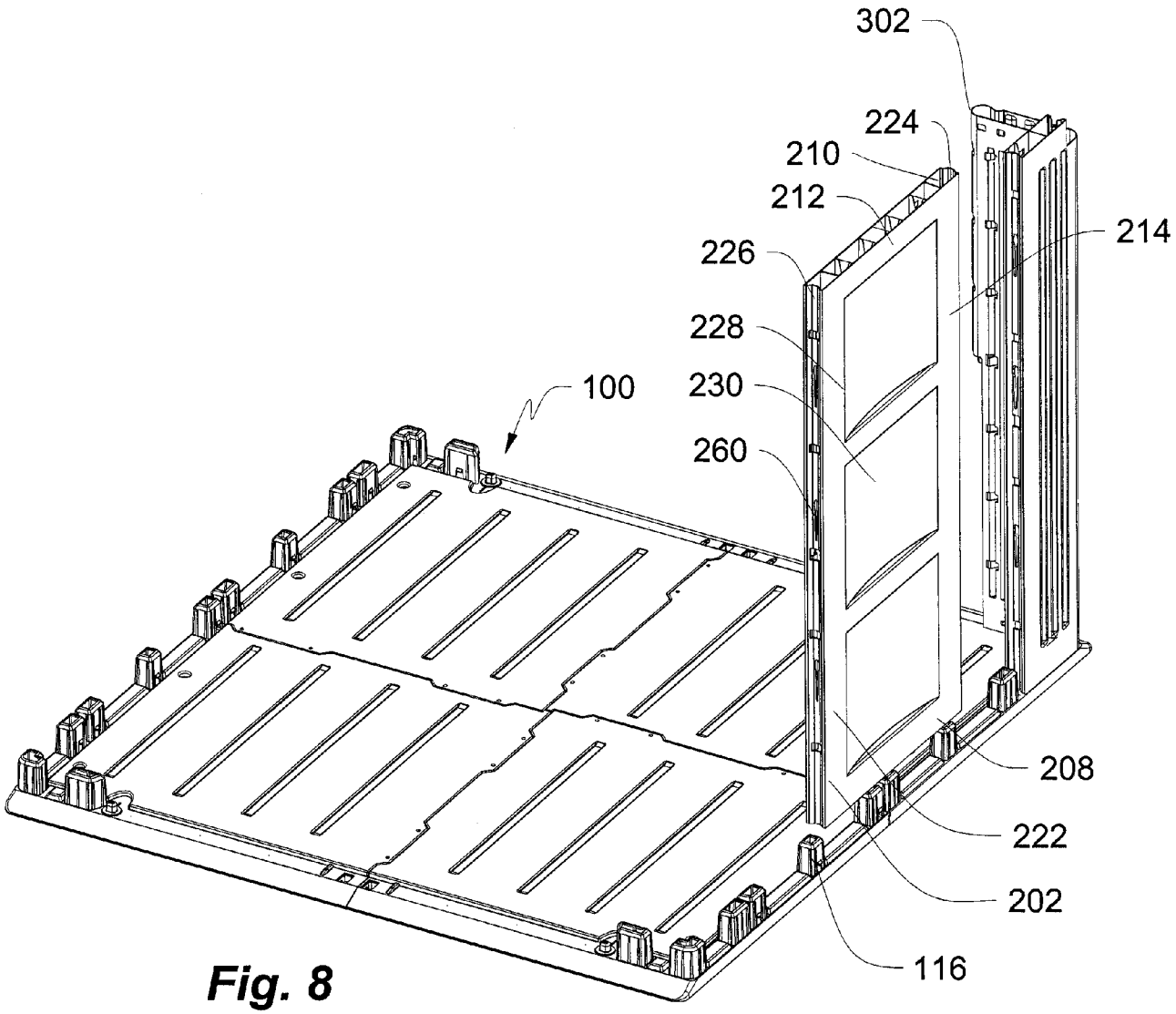
FIG. 8 is a perspective view illustrating assembly of a side wall panel to a corner pillar and the floor assembly.
Figure 9:
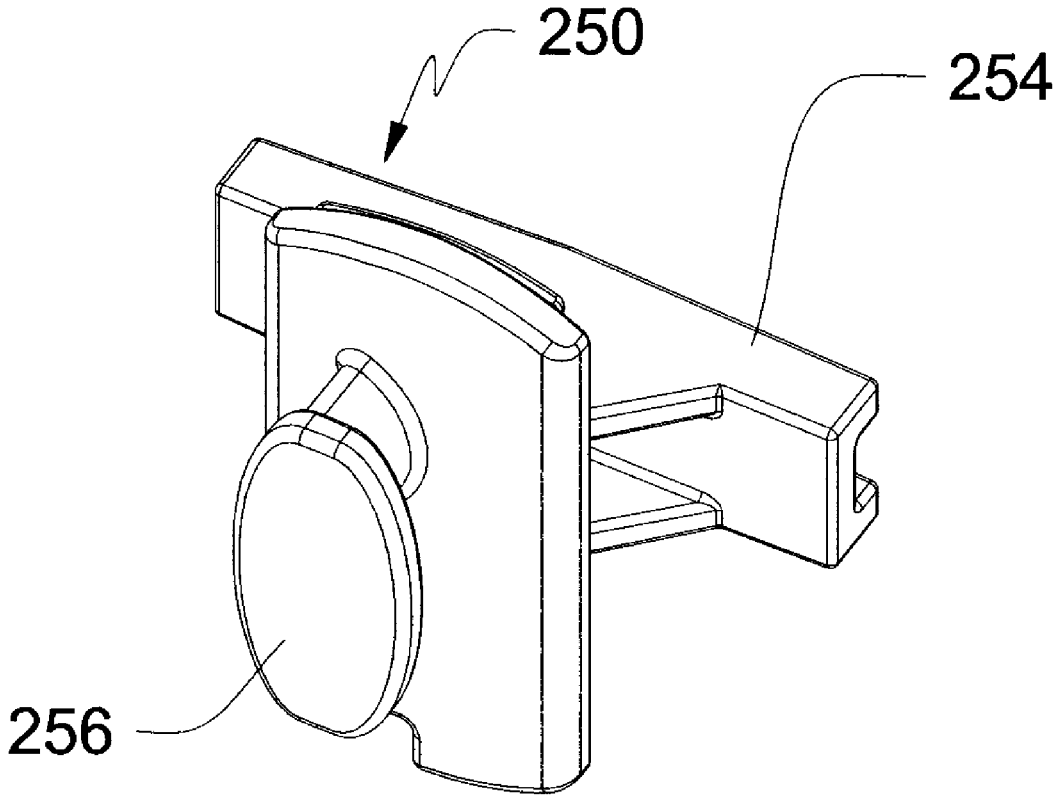
FIG. 9 is a perspective view of the T-connector utilized in the instant invention.

Referring to FIGS. 8 and 9 a structural side wall panel 202 is shown. The structural side wall panel 202 constitutes one of a plurality of like-configured panels in the system used to construct the left and right side wall assemblies 200. The structural side wall panels 202 are each configured having a first longitudinal end 208 including an integrally formed attachment means illustrated as a plurality of sockets 210. A second longitudinal end 212 also including an integrally formed attachment means illustrated as a plurality of sockets 210. The sockets 210 are generally constructed and arranged to cooperate with either a floor assembly 100 or a roof assembly 400 to facilitate mechanical connection in a generally perpendicular relationship. To facilitate mechanical connection with other structural panel members 200 in a co-planar relationship the panels are provided a first horizontal edge 214 constructed with an attachment means illustrated as an outwardly extending ridge 224. The ridge 221 extends from about the first longitudinal end 208 of the panel to about the second longitudinal end 212 of the panel. The ridge 224 is arranged to cooperate with a corner pillar member 302 or a side-panel member 202 having a complimentary groove in an interlocking coplanar relationship. The second horizontal edge 222 is constructed generally flat having an inwardly depending groove 226. The groove 226 extends from about the first longitudinal end 208 of the panel to about the second longitudinal end 212 of the panel. The groove 226 is arranged to cooperate with a corner pillar member 302 or a side-panel member 202 having a complimentary ridge in an interlocking coplanar relationship. For additional structural rigidity between the side wall panels, the first and second horizontal edge attachment means may also include at least one T-connector 250 (FIG. 9). The T-connector is generally constructed having a first end portion 254 and a second end portion 256.

The first end portion 254 is constructed and arranged for insertion through at least one slot 258 extending along the first horizontal edge 214 of the wall panels 200. The second horizontal edge 222 of the wall panels 200 are constructed and arranged with at least one key-hole slot 260 for insertion of said second end portion 256 of said at least one T-connector 250. In operation, the first end portion 254 is inserted into a first horizontal edge slot 258 and rotated about ninety degrees to secure the T-connector in place within the first horizontal edge of the side wall panel 214 or corner pillar 314. The outwardly extending second end portion 256 of the T-connector 250 is brought into an interlocking relationship with a corresponding key-hole slot 260 in an adjacent corner pillar or wall panel and slid downwardly resulting in a mechanically secure connection between the panels.

Figure 22:
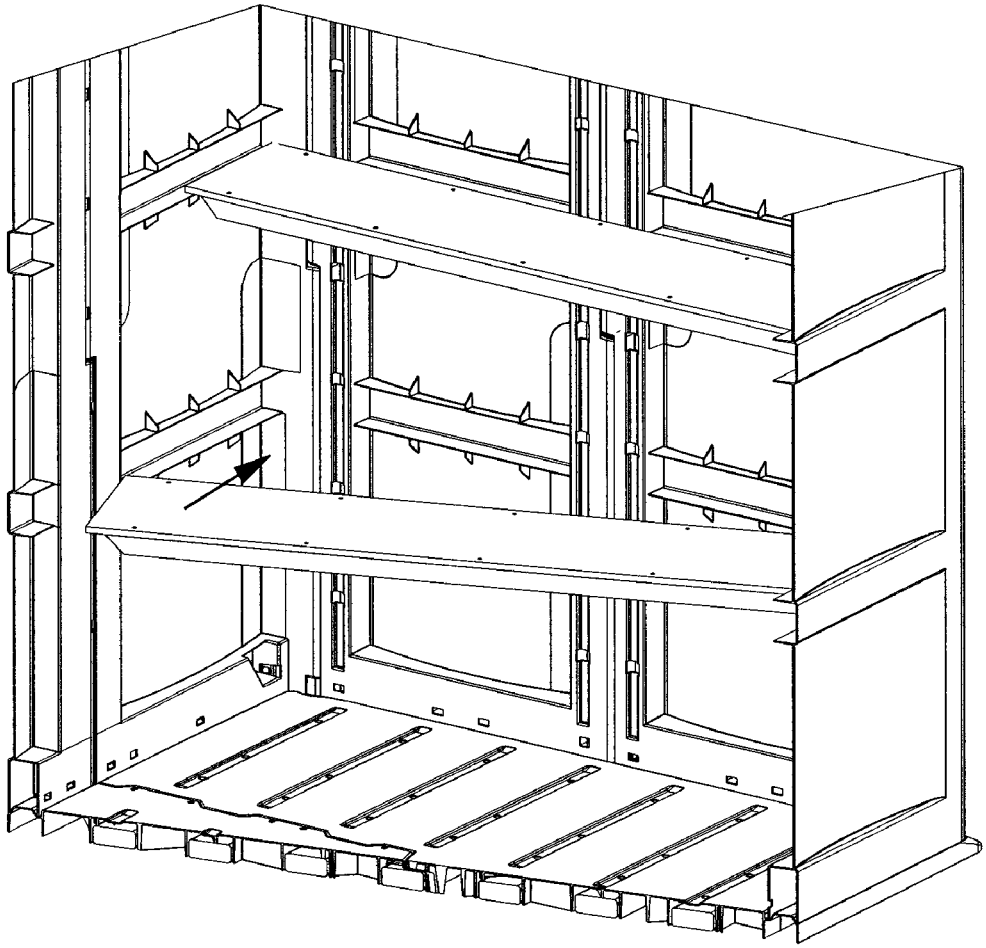
FIG. 22 is a partial sectioned view illustrating the cooperation of the optional shelves with the side panels in the instant invention.

Continuing with regard to FIG. 8, the outer surface 228 of the panels 202 are constructed generally smooth having a plurality of inwardly bowed surfaces 230 for added strength and aesthetic appearance. The inside of the panel 232 (FIG. 2) is constructed with a plurality of ribs 204 extending from the first edge 214 across the panel 202 to the second edge 222. Each of the ribs 204 being provided with a plurality of gussets 206 to further strengthen the panel 202. The ribs 204 and gussets 206 increase the structural integrity of the enclosure 10 by preventing the panels 202 from bowing or bending inwardly or outwardly, and thus, adversely affecting the appearance or operation of the enclosure 10. The reinforced ribs also provide support for optional shelves 600 (FIG. 22). The construction of the ribs 204 allow shelving to extend across the span of the shed thereby dividing the load between two walls and eliminating the cantilever effect of attaching a shelf to a single wall surface.

The left and right side wall panels 202 are attached to the interconnected floor-panels 102 and corner pillars 302 by sliding the first longitudinal end 208 over a plurality of the bosses 116. The sockets 210 in each end of the panels 202 correspond in shape and size to that of the bosses 116 and spring tabs 126 (FIG. 2) integrally formed into the bosses 116 align with apertures 234 in the pockets 210 to engage the side wall panel 202. The result is a positive mechanical connection between the wall-panels 200 and the floor assembly 100. The first wall panel being attached to the floor assembly 100 and the corner pillar 302 with the first longitudinal end 208 downward interlocking the two panels via the ridge, groove and T-connector arrangement extending along the sides of the wall panels. The second wall panel is thereafter attached in a coplanar relationship to the first panel interlocking the two panels via the ridge, groove, and T-connector arrangement extending along the sides of the wall panels.

Figure 10:
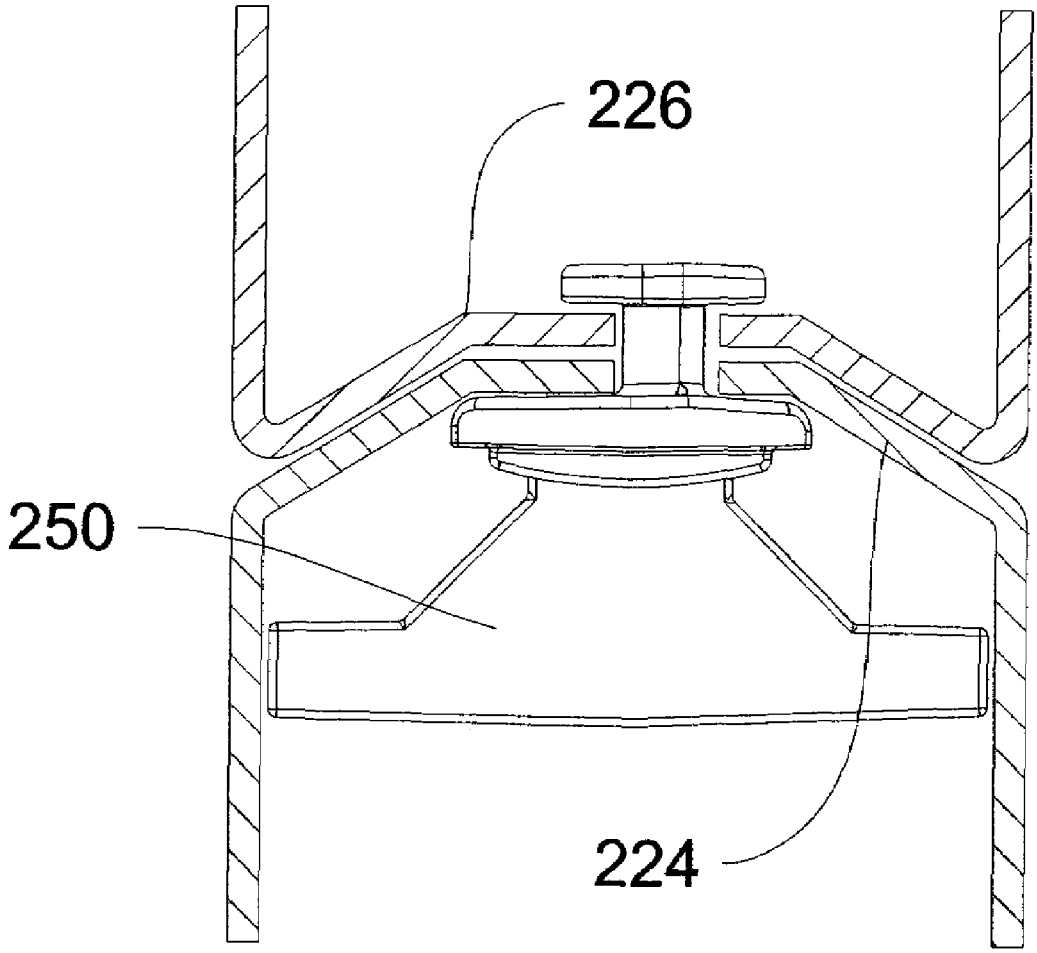
FIG. 10 is a cross sectional view illustrating the locking engagement between the T-connector(s) and adjacent wall panels.

It will be appreciated that the purpose of the ridge 224 and the groove 226 arrangement is to align two panels in an interlocking co-planar relationship and to facilitate their mechanical connection. The ridge 224 and the groove 226 are brought into an interlocking relationship wherein the ridge 224 enters the corresponding groove 226 (FIG. 10). The result is a mechanically secure connection between the two panels. The interlocking edges between the panels as described above provides a secure connection and offers several advantages. First, the design allows the panels to be connected without the need for I-beam connectors. Second, the design allows the panels to be formed at sufficient height for a walk-in enclosure by creating a positive lock that prevents separation of the panels. Third, the design maintains alignment of the panels in the same plane and prevents bowing or bending of either panel relative to one another. Fourth, the design provides a sealed connection between the panels preventing weather infiltration. The resultant wall created by the combination of the interlocking wall-panels benefits from high structural integrity and reliable operation.

Figure 11:
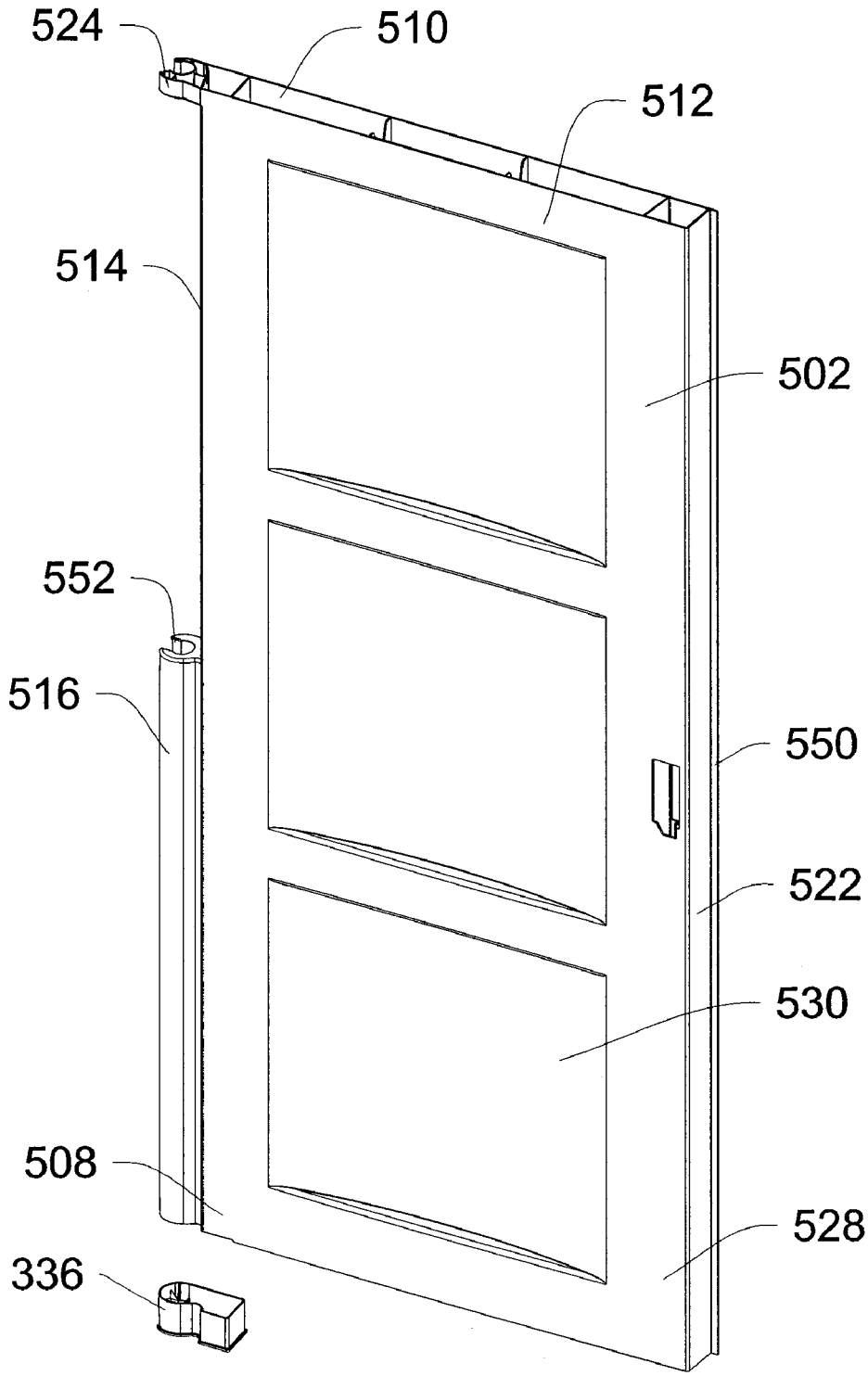
FIG. 11 is a perspective view illustrating one of the panels utilized for the rear wall and door assemblies of the instant invention.
Figure 12:
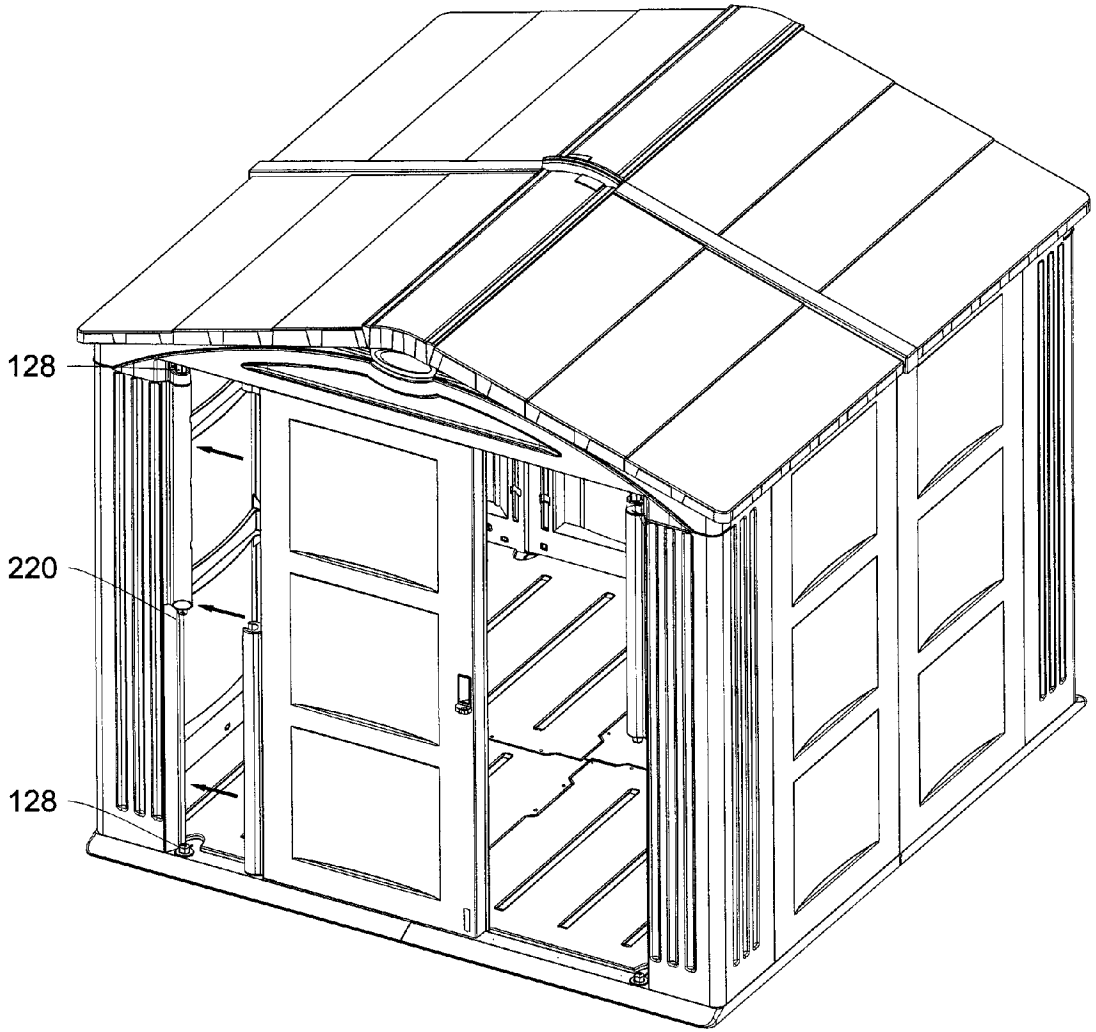
FIG. 12 is a perspective view illustrating assembly of the rear wall of the instant invention.
Figure 13:
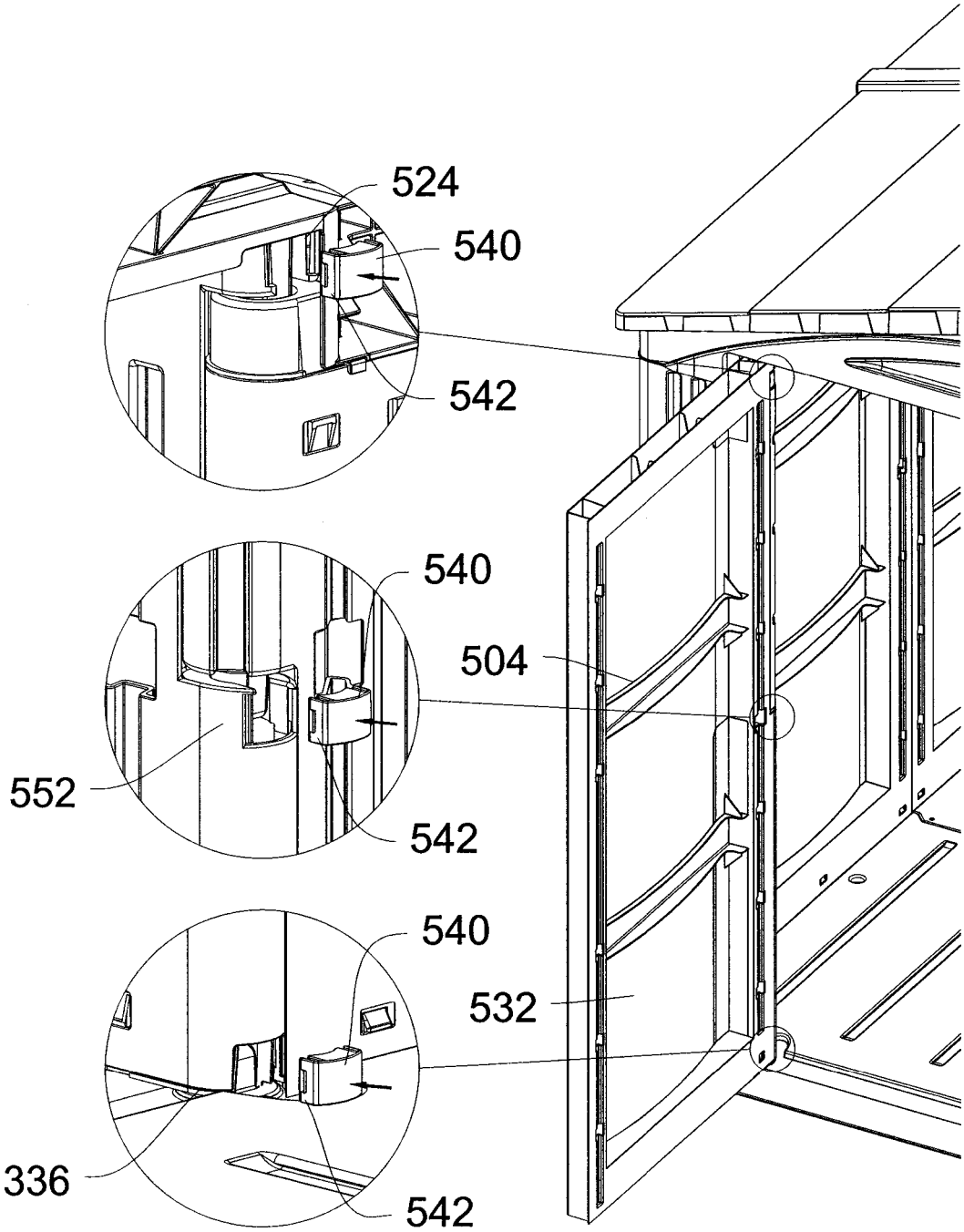
FIG. 13 is a partial perspective view of the enclosure with enlarged partial views illustrating assembly of the hinges.

Referring to FIGS. 11-13, the structural rear wall and door panel is shown. The rear wall panel 502 constitutes one of a plurality of like-configured panels in the system used to construct the rear wall assembly and the door assembly. The rear wall panels 502 are each configured having a first longitudinal end 508 and a second longitudinal end 512 each including an integrally formed attachment means illustrated as a plurality of sockets 510. The sockets 510 are generally constructed and arranged to cooperate with either a floor assembly 100 or a roof assembly 400 for generally perpendicular connection thereof. To facilitate pivotable mechanical connection with corner pillar members 302, the panels 502 are provided a first horizontal edge 514 constructed with a semi-circular conduit 516 extending from about the first longitudinal end 508 to about the middle portion of the edge. The conduit 516 is arranged to cooperate with other panel members having a complimentary semi-circular conduit in a co-planar, a perpendicular, or a pivotable relationship. Centrally located within the semi-circular conduit 516 is an integrally formed C-shaped annular hinge portion 552 for cooperation with adjacent semi-circular conduits. Also integrally formed on the first horizontal edge 514 at about the second longitudinal end 512 of the panels 502 is a C-shaped annular hinge portion 524 constructed and arranged to cooperate with a roof assembly hinge pin 128. For connection to a floor hinge pin 128 a hinge cap 336 is inserted into a socket 510 provided in the first end of the panel 502. The socket is generally constructed and arranged with a C-shaped annular portion to cooperate with a floor hinge pin 128. The second horizontal edge 522 of the panel 502 is constructed generally flat and may include an optional overlapping seal 550 to prevent moisture from entering the enclosure 10.

Continuing with regard to FIGS. 11-13, the outer surface 528 of the panels 502 are constructed generally smooth having a plurality of inwardly bowed surfaces 530 for added strength and aesthetic appearance. The inside of the panel 532 (FIG. 2) is constructed with a plurality of ribs 504 extending from the first edge 514 across the panel 502 to the second edge 522. Each of the ribs 504 being provided with a plurality of gussets 506 to further strengthen the panel 502. The ribs 504 and gussets 506 increase the structural integrity of the enclosure 10 by preventing the panels 502 from bowing or bending, inwardly or outwardly and thus, adversely affecting the appearance or operation of the enclosure 10.

The rear panels 502 are attached to the interconnected floor panels 102 and the installed corner pillars 302 by inserting a hinge cap 336 into a corresponding cavity 510 located in the first longitudinal end 508 of the panel 502 for engagement with the floor assembly 100, the first edge 514 of a rear wall panel is slid inward over dowels 220 and hinge pins 128 aligning the semi-circular conduits and engaging the respective hinge clips 540 (FIG. 12). The body of the hinge clip 540 (FIG. 13) is generally concave and rectangular and includes spring tabs 542 located at each end adapted to fit within the respective hinge caps to secure the door panels to the hinge and dowel pins and facilitate independent pivotal movement of each panel 502. To prevent the panel 502 from pivoting the rear panel is inserted over a floor panel connector 554 (FIG. 1). Spring tabs 556 integrally formed into the floor panel connector 554 align with apertures 534 in the panels 502 for engagement. The result is a positive mechanical connection between the corner pillars 300, rear panels 500 and the floor assembly 100. In this manner the panel members 502 can be configured as a fixed panel using the floor panel connector 554 or a pivotable panel by omitting the floor panel connector 554.

Figure 14:
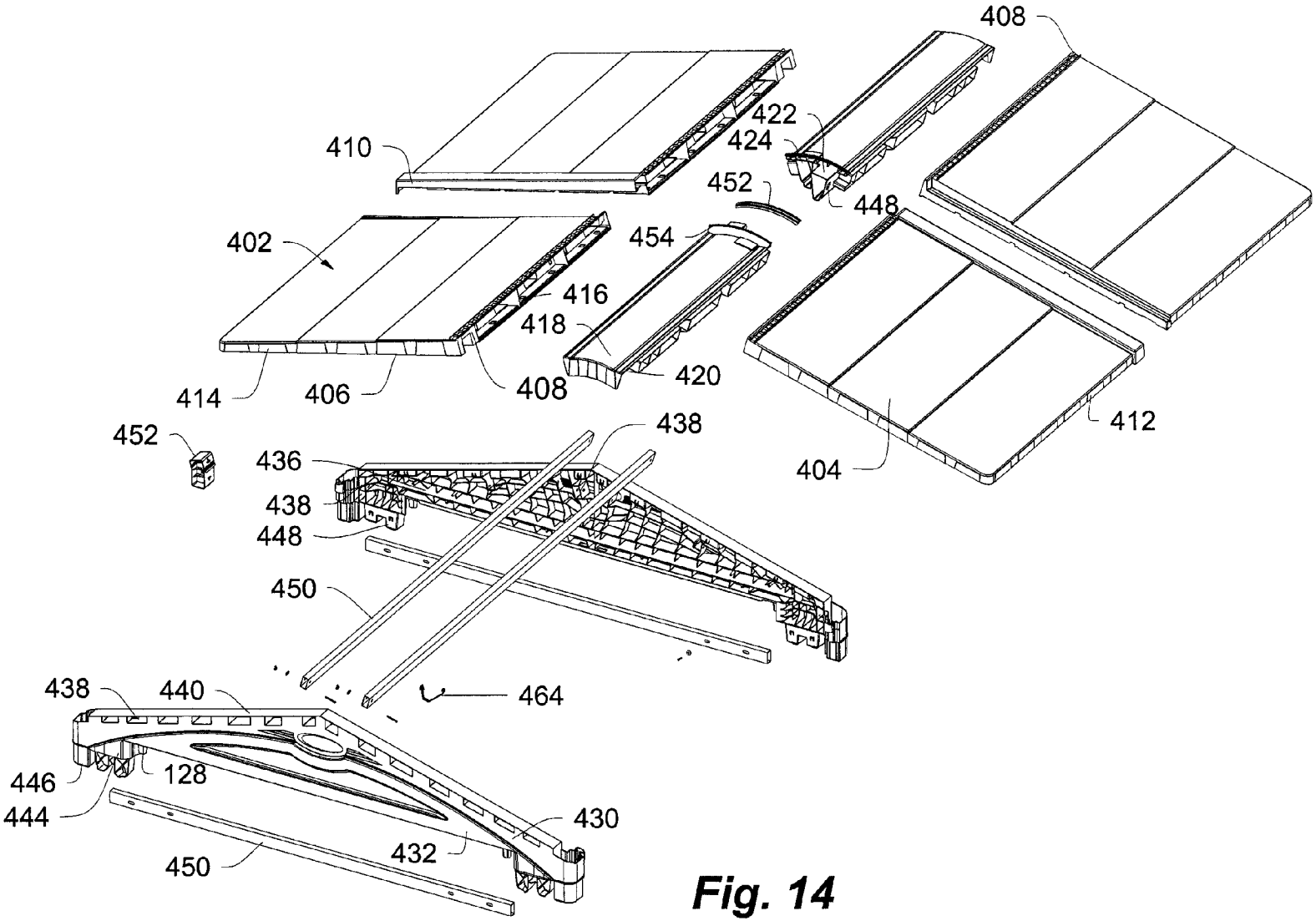
FIG. 14 is an exploded perspective view of the roof assembly utilized in the instant invention.
Figure 15:
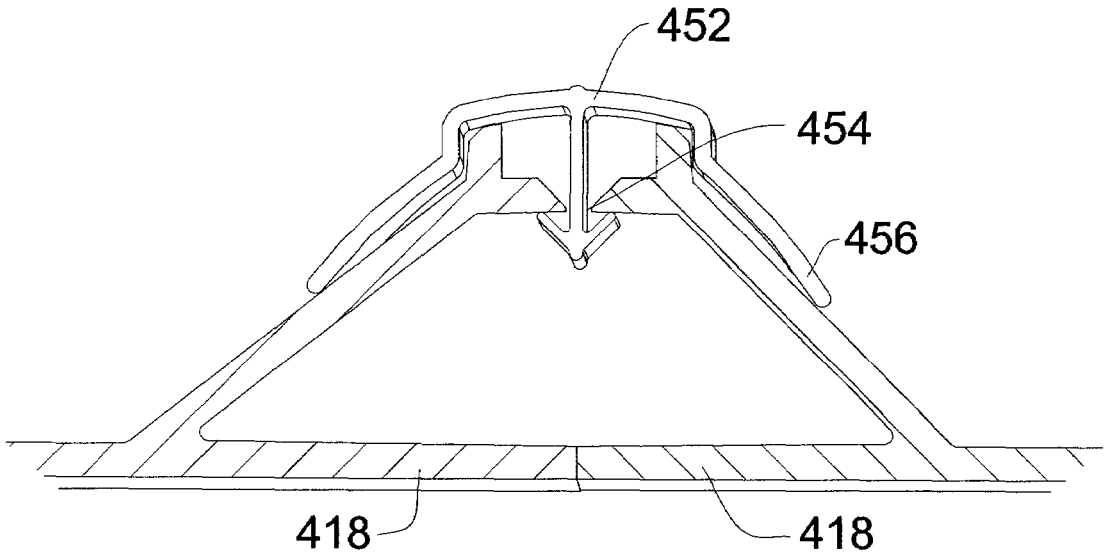
FIG. 15 is a partial cross sectional view illustrating the cooperation between the weatherstrip seal and the roof ridge cap panels.
Figure 16:
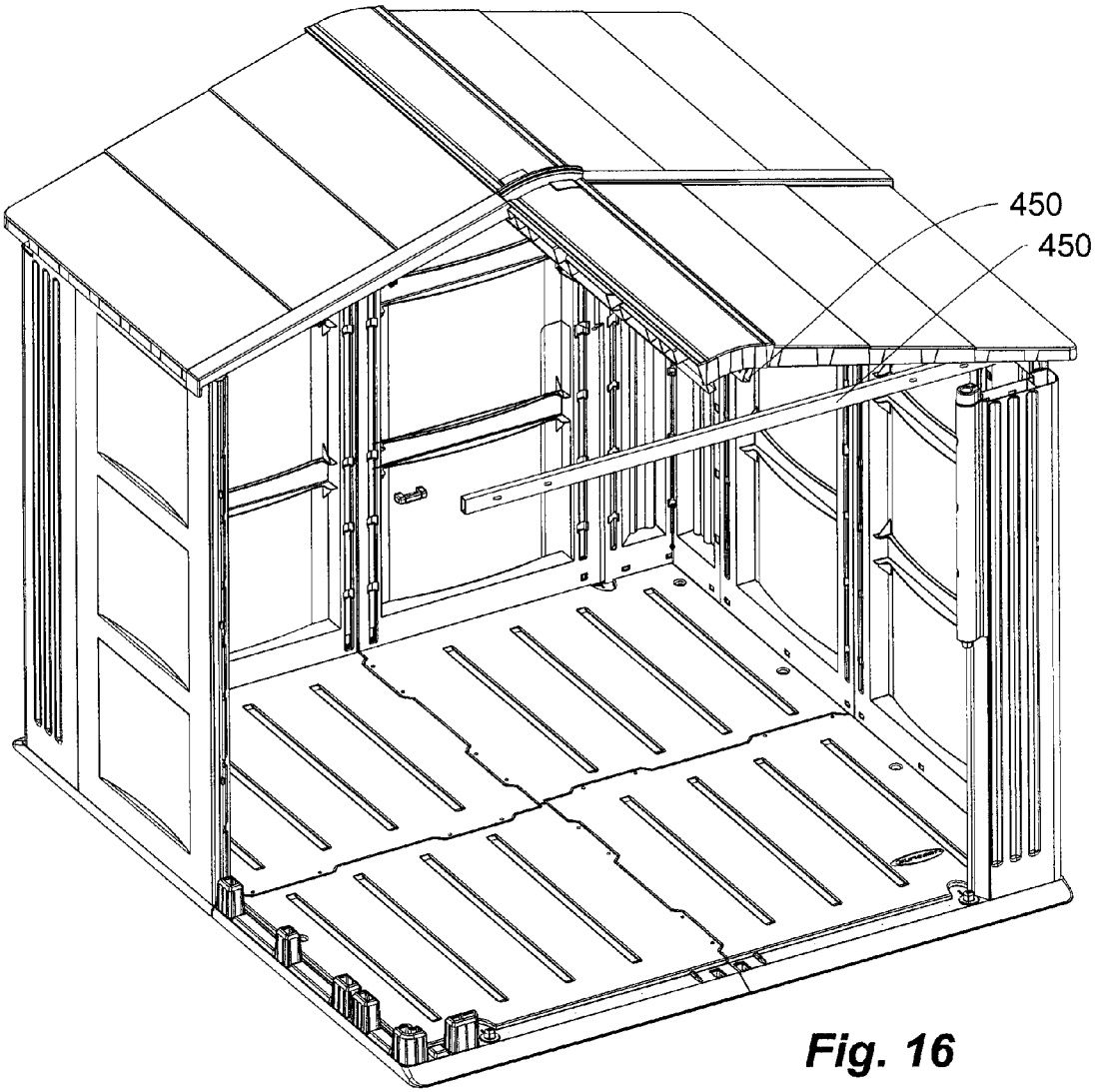
FIG. 16 is a perspective view illustrating the cooperation between the roof support beams and the roof assembly.
Figure 17:
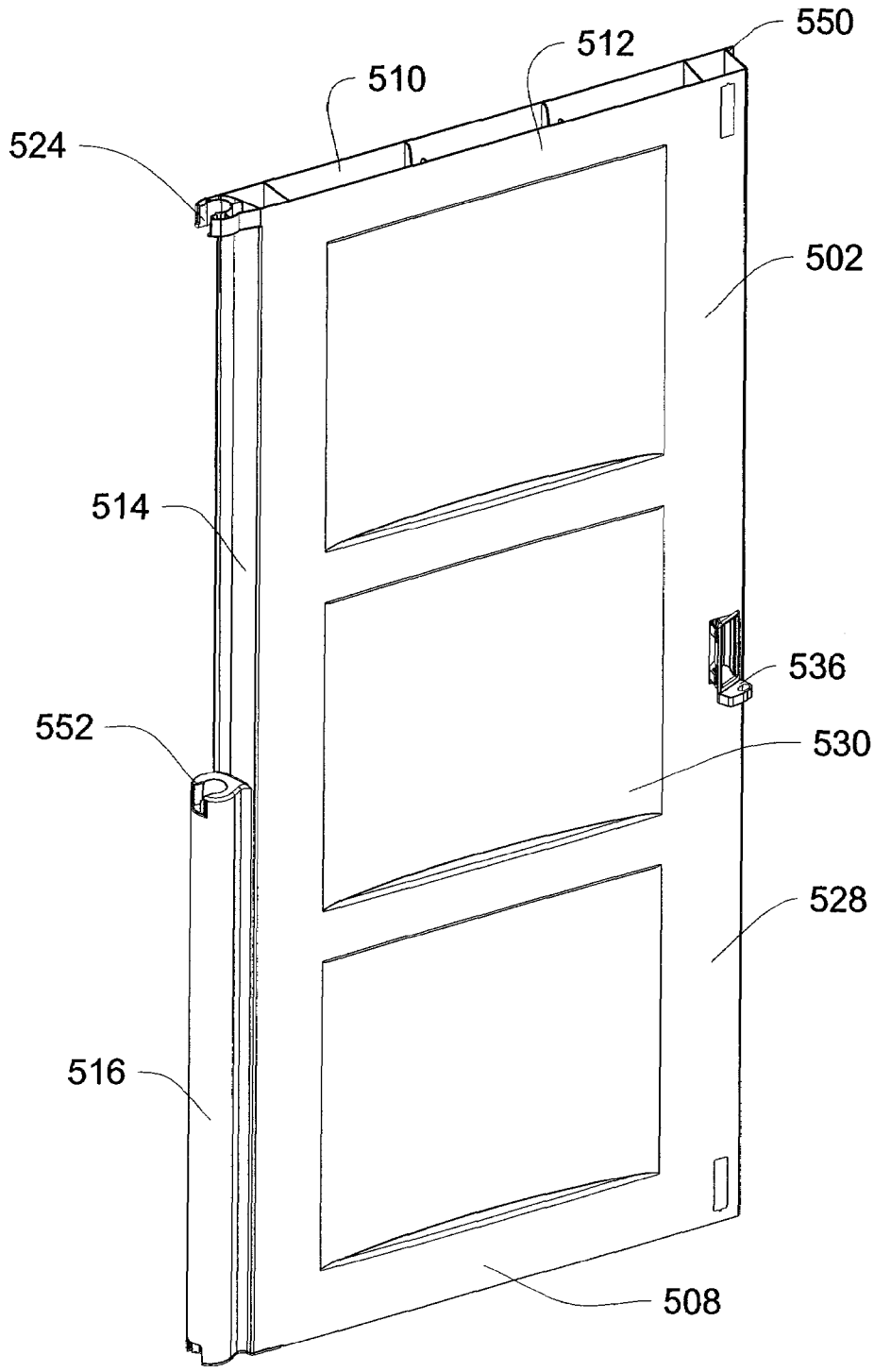
FIG. 17 is a partial exploded view illustrating the door assembly of the instant invention.

Referring to FIGS. 14-16 the roof assembly 400 includes two like constructed headers 430. The header is a truss like structure molded with an aesthetically pleasing generally smooth wall on its outer surface 432 and integrally formed cross bracing 436 and a plurality of sockets 438 constructed and arranged to accept reinforcement beams on its inner surface 434. The header also includes an upper surface 440 and a lower surface 444. The upper surface 440 includes a plurality of vents 442 that are constructed and arranged to allow airflow through the enclosure 10 but prevent weather related moisture from entering. The lower surface 444 includes a plurality outwardly extending bosses 446 constructed and arranged to cooperate with sockets located in the second end 308 of the corner pillars 302. The bosses 446 are slid into the respective corner pillar sockets 310 until the integrally formed spring tabs 448 engage corresponding apertures 334 formed in the corner pillar sockets. At least two and preferably six support beams 450 are inserted into their respective sockets 438 in each of the headers and secured in place with suitable fasteners. The support beams 450 are preferably constructed of steel, but may be constructed of other materials well known in the art capable of providing structural support to the roof assembly, such materials may include but should not be limited to plastic and/or wood as well as suitable combinations thereof. FIG. 17 is shown with a portion of the enclosure omitted for clarity, illustrating the placement of the support beams 450 in the preferred embodiment. The roof assembly 400 also includes two like constructed ridge caps 418 and two pair of like-constructed roof panels 402. The ridge caps 418 generally include at least one outwardly extending boss 422 and at least one socket 424 for securing the ridge caps together. The ridge cap 418 are slid together until the spring tabs 448 integrally formed into the bosses 422 engage corresponding apertures 438 (not shown) formed in the sockets 424. The assembled ridge cap is slid into place over the headers and fastened in cooperative engagement with the support beams 450 utilizing the anti-lift strapping 464. A weatherstrip 452 is utilized to seal the ridge cap assembly seam against leakage. Starting at one side of the ridge cap assembly, the weather strip 452 is fed into the groove 454 (FIG. 16) formed by connecting the two ridge caps 418 until it is centered.

Each roof panel has a top surface 404, bottom surface 406, a first locking edge 408, a second locking edge 410 and two closed edges 412 and 414. Along the bottom surface 406 adjacent to the closed edge 412 is a plurality of sockets 450 (not shown) constructed and arranged to receive roof connectors 452. The roof connectors are constructed and arranged to cooperate with sockets 210 located at second longitudinal end 212 of the structural wall panels 202 as well as the sockets 450 located on the lower surface 406 of the roof panels 402. A series of spaced apart structural tubes 418 (FIG. 15) extend through each roof panel 402 under the top surface 404 and between the first locking edge 408 and the first closed edge 412. The first locking edge 408 of each roof panel 402 is configured as an interlocking sleeve 416 constructed and arranged to cooperate with a ridge cap 418 having a conjugately shaped projection 420 to create a weather resistant seal. The roof panels 402 are slid over the projection 420 until the integrally formed spring tabs (not shown) engage corresponding apertures formed in the ridge cap 418.

FIG. 15 shows the resilient weatherstrip seal 452, which takes the general cross section of a flared U with an arrow extending downwardly from the apex of the radius. The weatherstrip seal 452 is constructed from a resilient material allowing the free edges 456 to be spread outwardly as the strip 452 is slid into the place creating a watertight seal between the top surface of the ridge caps 418 and the weatherstrip 452. Moreover, the ridge cap 418 construction provides an elevated position for the weatherstrip 452 allowing water to be quickly directed away from the weatherstrip. It is also understood and anticipated that other suitable types of weatherstrips and/or sealants well known in the art could replace the illustrated weatherstrip seal.

It should be appreciated that Assembling the roof assembly onto the enclosure is performed before the doors are assembled to the enclosure. This eliminates the tedious task of aligning the doors as the roof is attached to the structure, thereby simplifying assembly over the prior art.

Figure 19:
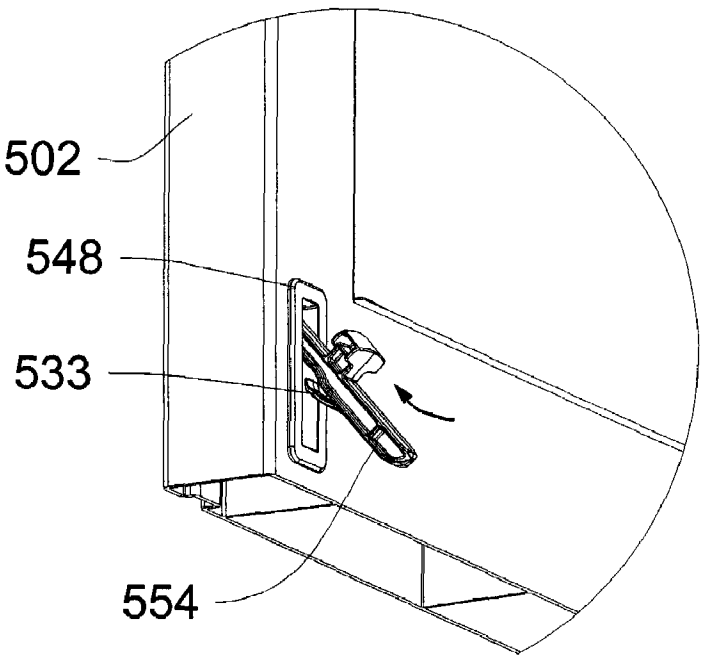
FIG. 19 is a partial view illustrating assembly of one of the door latch pins utilized in the instant invention.
Figure 20:
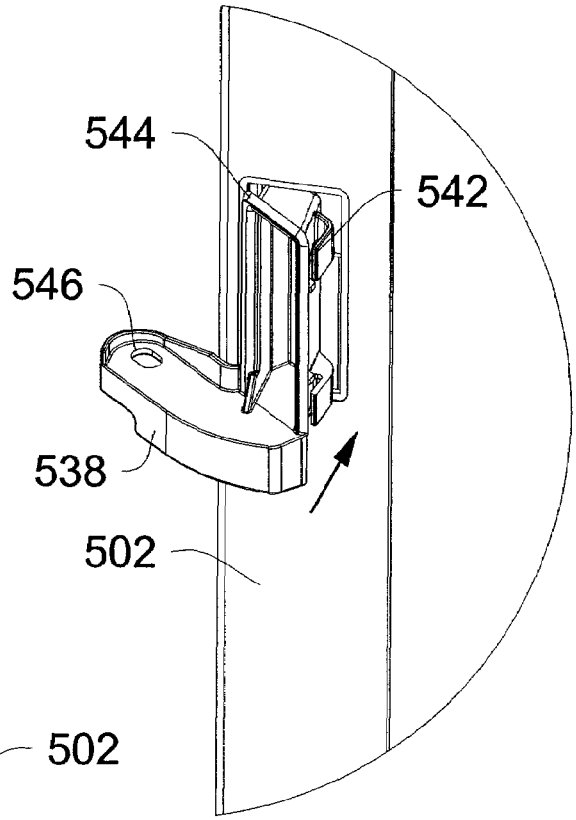
FIG. 20 is a partial view illustrating assembly of one of the door handles utilized in the instant invention.
Figure 21:
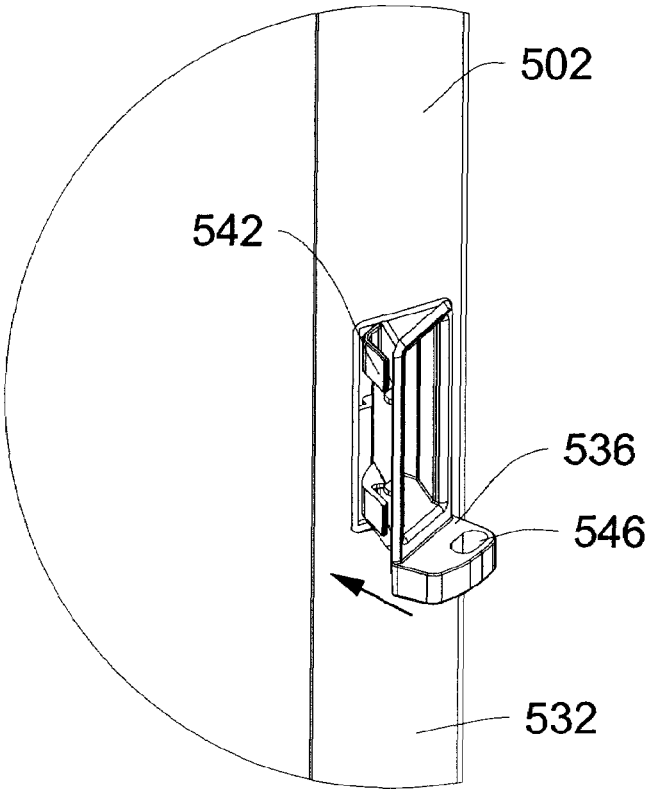
FIG. 21 is a partial view illustrating assembly of one of the door handles utilized in the instant invention.

Referring to FIGS. 17-21, the enclosure door assembly includes a pair of door panels, a hinge means, a door handle assembly, and a latch assembly. The door panel 502 constitutes one of a plurality of like-configured panels in the system used to construct the back wall assembly and the door assembly. The door panels 502 are configured each having a first longitudinal end 508 including at least one integrally formed socket 510. The socket 510 is generally constructed and arranged to cooperate with a hinge cap 336 having a C-shaped annular portion. A second longitudinal end 512 including an integrally formed C-shaped annular hinge portion 524. To facilitate mechanical connection with corner pillar members 302 in a pivoting relationship the panels are provided a first horizontal edge 514 constructed with a semi-circular conduit 516 extending from about the first longitudinal end 508 to about the middle portion of the edge. The hinge cap 336, integrally formed hinge portion 524, and the semi-circular conduit 516 each containing at least one hinge means illustrated as a C-shaped annular portion 518 having an open side 520 constructed and arranged to accept a hinge pin 128 or a dowel pin 220 and to cooperate with a hinge clip 540 to close the annular cavity 518 and allow pivoting movement of the door panel 502. The second horizontal edge 522 is constructed generally flat with the exception of a optional overlapping seal 550 extending the full length of the panel. The optional overlapping seal 550 may be attached by any suitable fastening means well known in the art or may be integrally formed with the panel. The door panels 502 are also provided with an upper and lower sliding latch mechanism 533 (FIGS. 18-19) and a left and right door handles 536, 538 (FIGS. 20-21).

Continuing with regard to FIGS. 17-21, the outer surface 528 of the panels 502 are constructed generally smooth having a plurality of inwardly bowed surfaces 530 for added strength and aesthetic appearance. The inside of the panel 532 (FIG. 2) is constructed with a plurality of ribs 504 extending from the first edge 514 across the panel 502 to the second edge 522. Each of the ribs 504 may be provided with a plurality of gussets (not shown) to further strengthen the panel 502.

The ribs 504 increase the structural integrity of the enclosure 10 by preventing the panels 502 from bowing or bending, inwardly or outwardly and thus, adversely affecting the appearance or operation of the enclosure 10.

The door panels 502 are attached to the interconnected floor panels 100, left and right corner pillars 300, and roof panels 400 by sliding the respective hinge cap 336 into the corresponding cavity 510 located in the first end 508 of the door panels. Either door panel 502 is aligned with the hinge pins by sliding it horizontally into place over the respective pins and engaging the hinge clips 540 (FIGS. 12 and 13). The body of the hinge clip 540 is generally concave and rectangular and includes spring tabs 542 located at each end adapted to fit within the respective hinge caps to secure the door panels to the hinge pins and facilitate independent rotational movement of each door. It should be appreciated that this construction allows the doors to be installed or removed without disassembling or partially disassembling other components from the enclosure 10. The construction also provides economic advantage allowing inexpensive hinge components to be easily removed and replaced in the event they become damaged while reusing the same panel. The door panels are also provided with removable and replaceable door latching mechanisms including slide latches 533, left door handle 536 and right door handle 538 (FIG. 20).

Figure 18:
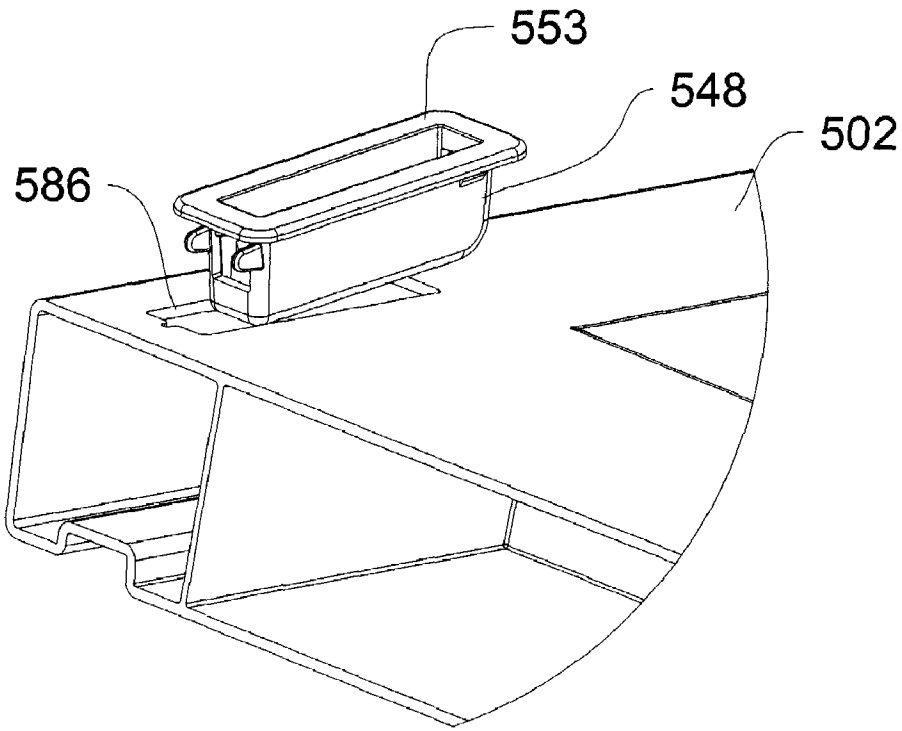
FIG. 18 is a partial view illustrating assembly of one of the door latch housings utilized in the instant invention.

Referring to FIGS. 18-19, installation of the upper and lower door latches is illustrated. The door latches are constructed and arranged to allow simple push-in installation. The latch housings 553 are merely pushed into apertures 546 located adjacent to edge 522 in the door panels 502 until the spring clips 548 engage the back surface 532 of panel 502. Thereafter the one end of the door latch pin 554 is inserted through the housing 552 and downwardly until spring clip 550 is snapped into place. In this manner the door latches can be installed and removed as need without the need for tools or screw type fasteners. By sliding the latch pin 554 to extend it outwardly to engage the roof assembly 400 or the floor assembly 100 the contents contained within the enclosure 10 are secured.

Referring to FIGS. 20-21, installation of the left door handle 536 and right door handle 538 are illustrated. The door handles are constructed and arranged to allow simple push-in installation. The handles are merely pushed into apertures 544 contained in door panels 502 until the spring clips 542 engage the back surface 532 of panel 502. In this manner the door handles can be installed and removed as need without the need for tools or screw type fasteners. The handles are also provided with lock apertures 546 allowing the contents contained within the enclosure to be secured with a padlock or the like.

Figure 23:
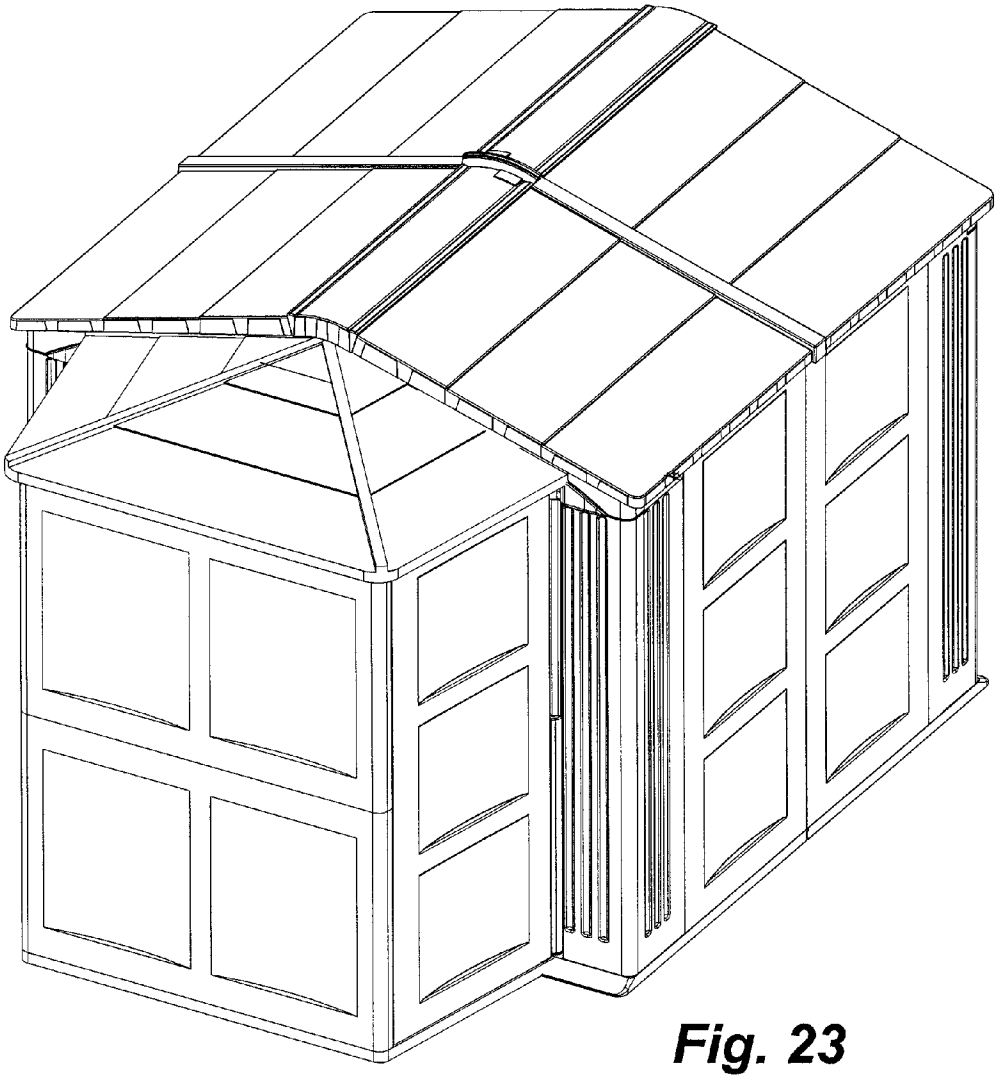
FIG. 23 illustrates an alternative embodiment of the instant invention.
Figure 24:
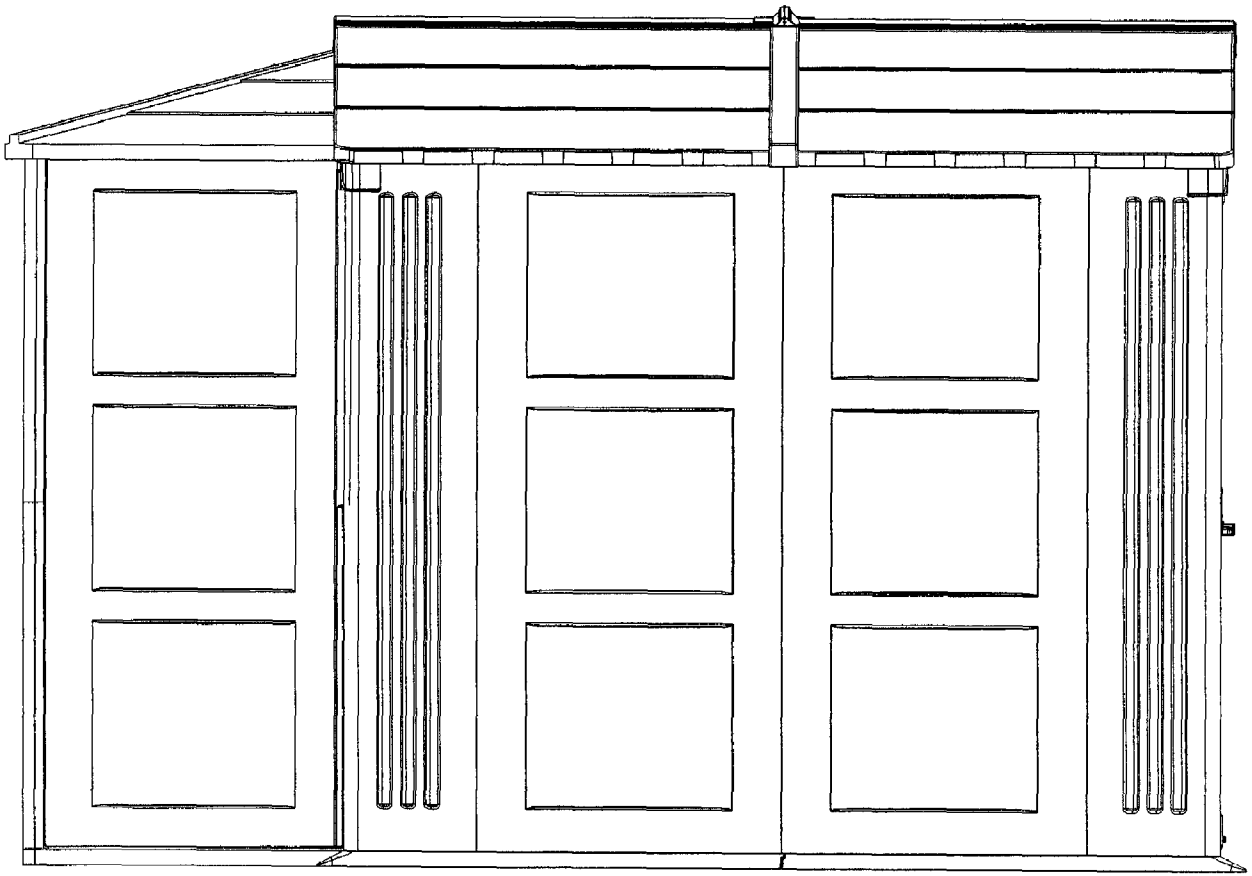
FIG. 24 is an elevatiuonal view of the alternative embodiment of FIG. 23.

Referring to FIGS. 23-24, an alternative embodiment of the present invention is shown wherein the enclosure is made larger by adding floor panels, roof panels, and adding additional side wall panels. The enlarged enclosure may also include additional door panels to facilitate entering the shed at more than one position. In this manner the same construction can be utilized to build structures of varying size utilizing substantially the same components.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A heavy duty injection molded utility enclosure comprising:

a floor assembly for enclosing the bottom of said heavy duty enclosure;

four L-shaped corner pillars for providing strength and rigidity to said enclosure;

a pair of side wall assemblies for enclosing the left side and right side of said heavy duty enclosure, each of said side wall assemblies including at least one side wall panel member, wherein said at least one wall panel member includes a first longitudinal end having an attachment means constructed and arranged to cooperate with a floor assembly or a roof assembly, a second longitudinal end having an attachment means constructed and arranged to cooperate with a floor assembly or a roof assembly, a first horizontal edge having an attachment means constructed and arranged to cooperate with a side wall panel member or a corner pillar member in an interlocking co-planar relationship and a second horizontal edge having an attachment means constructed and arranged to cooperate with a side wall panel member or a corner pillar member in an interlocking co-planar relationship, said first horizontal edge attachment means including at least one slot constructed and arranged for attachment of at least one T-connector, said at least one T-connector having a first end portion and a second end portion, wherein said first end portion of said at least one T-connector is inserted into said first or said second horizontal edge and secured in place by rotation of said T-connector within said slot, wherein said second end portion of said at least one T-connector extends outwardly from said first horizontal edge for interlocking cooperation with a corresponding key-hole slot in an adjacent side wall panel or corner pillar resulting in a mechanically secure connection between said panels;

a rear wall assembly for enclosing the back of said heavy duty enclosure;

a door assembly for enclosing and providing ingress into and egress from said heavy duty enclosure;

a roof assembly for enclosing the top of said heavy duty enclosure system;

wherein a heavy duty enclosure can be shipped in a disassembled state and assembled on a desired site.

2. The heavy duty enclosure of claim 1 wherein said symmetrical floor assembly includes;

two pair of like-configured floor panel members for constructing said floor assembly, each of said floor members including, a top surface including a means of attaching said floor assembly to said wall and said door assemblies, a bottom surface constructed and arranged to provide rigidity and stability to said floor assembly, a first locking edge constructed and arranged with a means to connect like-configured locking edges of said like-configured floor panels to construct said floor assembly, a second locking edge constructed and arranged with a means to connect like-configured locking edges of said like-configured floor panels into said floor assembly, a ramp edge for easy loading and unloading of said heavy duty enclosure, a closed edge for maintaining a weather resistant enclosure.

3. The heavy duty enclosure of claim 2 wherein said means to connect like-configured locking edges includes a series of spaced apart fingers and recesses along said first and said second locking edges of each said floor panel, each of said fingers being provided with at least one countersunk aperture for receiving a fastener, said fingers and recesses constructed and arranged so that said fingers overlap and mateably engage said recesses and said fasteners secure said floor panel members together in an inter-fitting engagement with their respective top surfaces in a co-planar arrangement.

4. The heavy duty enclosure of claim 2 wherein said floor panel members include a plurality of spaced apart tubes extending through each said floor panel under said top surface and above said bottom surface and extending between said first locking edge and said ramp edge, said tubes being constructed and arranged for adding increased weight capacity and stability to said enclosure.

5. The heavy duty enclosure of claim 2 wherein said means of attaching said side wall assemblies and said corner pillars to said floor assembly top surface includes a plurality of locking bosses arranged in a linear fashion adjacent to said closed edge and said ramp edge, said bosses extending upwardly from said top surface, said locking bosses constructed and arranged to cooperate with said corner pillars and said wall assemblies in an interlocking manner;

wherein said corner pillars and said side wall assemblies are secured to said floor panels via said locking bosses.

6. The heavy duty enclosure of claim 5 wherein said means of attaching said door assembly to said floor assembly top surface includes at least one hinge pin arranged adjacent to said locking bosses and said ramp edge, said hinge pin constructed and arranged to cooperate with said door assembly so that said door assembly is allowed to open and close in a pivotal fashion.

7. The heavy duty enclosure of claim 5 wherein said means of attaching said rear wall assembly to said floor assembly top surface includes at least one hinge pin arranged adjacent to said locking bosses and said ramp edge, said hinge pin constructed and arranged to cooperate with said door assembly and at least one floor panel connector having a first boss end and a second boss end, said first end constructed and arranged for insertion into a socket located adjacent to said ramp edge of said floor assembly, said second boss end extending upwardly from said top surface of said floor assembly and constructed and arranged to cooperate with an inwardly extending socket formed into said rear wall panel;

wherein said rear wall assembly is secured to said floor panels via said locking bosses.

8. The heavy duty enclosure of claim 2 wherein said bottom surface includes integrally formed cross-bracing;

wherein said cross-bracing provides increased weight capacity and stability to said enclosure.

9. The heavy duty enclosure of claim 1 wherein said side wall assemblies includes at least four like-constructed side wall panel members for constructing a right side wall assembly and a left side wall assembly for said heavy duty enclosure system;

wherein said left side wall assembly includes two of said side wall panels and said right side wall assembly includes two of said side wall panels.

10. The heavy duty enclosure of claim 1 wherein said first longitudinal end attachment means includes at least one integrally formed socket and said second longitudinal end attachment means includes at least one integrally formed socket.

11. The heavy duty enclosure of claim 1 wherein said first horizontal edge attachment means includes a ridge extending from about the first longitudinal end to about the second longitudinal end of said edge;

wherein said ridge is brought into an interlocking relationship with a corresponding groove in an adjacent pillar or wall panel resulting in a mechanically secure connection between said panels.

12. The heavy duty enclosure of claim 1 wherein said second horizontal edge attachment means includes a groove extending from about the first longitudinal end to about the second longitudinal end of said edge;

wherein said groove is brought into an interlocking relationship with a corresponding ridge in an adjacent pillar or wall panel resulting in a mechanically secure connection between said panels.

13. The heavy duty enclosure of claim 1 wherein said second horizontal edge attachment means includes at least one key-hole slot constructed and arranged for insertion of said second end portion of said at least one T-connector, wherein said second end portion of said at least one T-connector is inserted into said key-hole slot and slid downwardly to secure said at least one T-connector in place;

wherein said first end portion of said T-connector is secured in place in said first horizontal edge of an adjacent wall panel resulting in a mechanically secure connection between said panels.

14. The heavy duty enclosure of claim 1 wherein said rear wall assembly includes a pair of like-constructed rear wall panel members, said rear wall panel members having a first longitudinal end with an integral attachment means constructed and arranged to cooperate with a floor assembly or a roof assembly, a second longitudinal end having an attachment means constructed and arranged to cooperate with said roof or said floor assemblies, a first horizontal edge having an attachment means constructed and arranged to cooperate with a corner pillar member, a second horizontal edge constructed and arranged to cooperate with at least one panel member to provide a weather resistant seal.

15. The heavy duty enclosure of claim 14 wherein said first horizontal edge attachment means includes a semi-circular conduit extending from about said first longitudinal end to about the middle portion of said edge, said conduit having a generally circular aperture for accepting a dowel centrally located within said middle portion end of said semi-circular conduit;

wherein said semi-circular conduit is brought into an overlapping relationship with a corresponding semi-circular conduit and a dowel pin enters and extends between said circular apertures in each conduit resulting in a mechanically secure connection between the two said panels.

16. The heavy duty enclosure system of claim 15 wherein said first horizontal edge attachment means includes at least two C-shaped annular portions integrally formed at about said first and said second longitudinal ends of said first horizontal edge, a C-shaped annular portion formed in said semi-circular conduit at about said middle portion of said edge, each of said C-shaped annular portions adapted to cooperate in an interlocking manner with a hinge cap, each said hinge cap including an integrally formed C-shaped annular portion slidingly engagable into a corresponding annular portion;

whereby said rear wall panels are attached to said interconnected floor panels, said corner pillars, and said roof panels by sliding each said rear wall panel horizontally into place over a plurality of hinge pins arranged to enter said annular portions and wherein said hinge caps are slidingly engaged to said C-shaped annular portions to close said each respective C-shaped annular portions to secure said panels to said hinge pins.

17. The heavy duty enclosure of claim 1 wherein said roof assembly includes at least two headers, a ridge cap assembly, and two pair of like-constructed roof panels.

18. The heavy duty enclosure of claim 17 wherein said roof assembly includes at least one support beam, wherein said at least one support beam provides increased structural load bearing capacity to said roof assembly.

19. The heavy duty enclosure of claim 18 wherein said support beam is constructed of steel.

20. The heavy duty enclosure of claim 18 wherein said support beam is constructed of plastic.

21. The heavy duty enclosure of claim 18 wherein said support beam is constructed of a composite material.

22. The heavy duty enclosure of claim 17 wherein said at least two headers include an outer surface, an inner surface, an upper surface, and a lower surface, wherein said upper surface includes a plurality of vents constructed and arranged to allow airflow through the enclosure while preventing weather related moisture from entering said enclosure, wherein said lower surface includes a plurality of outwardly extending bosses constructed and arranged to cooperate with sockets located in a second end of said corner pillars, wherein said bosses are slid into the respective corner pillar sockets until the integrally formed spring tabs engage corresponding apertures formed in the corner pillar sockets.

23. The heavy duty enclosure of claim 17 wherein each of said at least two headers include an inner surface, said inner surface including a plurality of integrally formed sockets, each said sockets constructed and arranged to cooperate with a support beam extending between said at least two headers to provide increased weight capacity to said roof assembly.

24. The heavy duty enclosure of claim 17 wherein said ridge cap assembly includes two like constructed portions each including an outer surface, a inner surface, a first locking end, and a second closed end, and a first and second edge, wherein said first locking end is constructed and arranged to cooperate with like constructed ridge caps for interfitting engagement, wherein said second closed end is constructed and arranged to resist weather infiltration, wherein said first and second edges include an attachment means constructed and arranged to cooperate with said roof panels for weather resistant engagement.

25. The heavy duty enclosure of claim 24 wherein said ridge cap assembly includes a weatherstrip, said weatherstrip constructed and arranged to cooperate with said cooperating first ends of said like constructed ridge caps to provide a weather resistant seal therebetween.

26. The heavy duty enclosure of claim 24 wherein said inner surface of said ridge cap portions are constructed and arranged to cooperate with said at least one support beam to provide increased structural integrity to said enclosure.

27. The heavy duty enclosure of claim 26 wherein said ridge cap assembly includes at least one anti-lift strap for securing said ridge cap portions to said at least one support beams.

28. The heavy duty enclosure of claim 17 wherein said like-constructed roof panels include an outer surface, an inner surface, a first locking edge, a second locking edge, a first closed edge opposite said first locking edge, and a second closed edge opposite said second locking edge wherein said first locking edge is constructed and arranged to cooperate with said first or said second edge of said ridge cap for weather resistant engagement, wherein said second locking edge is constructed and arranged to cooperate with a second locking edge of an adjacent roof panel for weather resistant engagement, wherein said inner surface is constructed and arranged with a means of attaching said roof panels to said wall panels.

29. The heavy duty enclosure of claim 28 wherein said means of attaching said roof panels to said wall panels includes a plurality of sockets arranged in a linear fashion adjacent to said first closed edge, wherein each said socket is constructed and arranged to cooperate with a connector for attachment to a corresponding socket in an upper edge of said wall panel assemblies.

30. The heavy duty enclosure of claim 28 wherein said roof panels include a plurality of spaced apart structural tubes extending through each roof panel between said outer surface and said inner surface extending between said first locking edge and said first closed edge.

31. The heavy duty enclosure system of claim 30 wherein at least one of said tubes is constructed and arranged as a socket within said first locking edge to for receiving at least one locking boss for attaching said like-configured roof panels to said ridge cap.

32. The heavy duty enclosure system of claim 1 wherein said door assembly includes a pair of like-constructed door panels each having a first longitudinal end including at least one integrally formed socket, said socket constructed and arranged to cooperate with a hinge means, a second longitudinal end including an integrally formed hinge means, a first horizontal edge having a semi-circular conduit extending from about said first longitudinal end to about the middle portion of said edge said conduit having an integrally formed hinge means, a second horizontal edge being generally flat.

33. The heavy duty enclosure system of claim 32 wherein said hinge means includes a C-shaped annular portion for accepting a hinge pin, said C-shaped annular portion constructed and arranged to cooperate with a hinge clip to close said annular portion and allow pivoting movement of said door panels;

wherein said C-shaped hinge means allows said door panels to be assembled to said enclosure without partial disassembly of other portions of said enclosure.

34. A heavy duty injection molded utility enclosure comprising:

a floor assembly for enclosing the bottom of said heavy duty enclosure;

four L-shaped corner pillars for providing strength and rigidity to said enclosure;

a pair of side wall assemblies for enclosing the left side and right side of said heavy duty enclosure;

a rear wall assembly for enclosing the back of said heavy duty enclosure;

a door assembly for enclosing and providing ingress into and egress from said heavy duty enclosure;

a roof assembly for enclosing the top of said heavy duty enclosure system, said roof assembly including at least two headers, a ridge cap assembly, and two pair of like-constructed roof panels, said at least two headers including an outer surface, an inner surface, an upper surface, and a lower surface, wherein said upper surface includes a plurality of vents constructed and arranged to allow airflow through the enclosure while preventing weather related moisture from entering said enclosure, wherein said lower surface includes a plurality of outwardly extending bosses constructed and arranged to cooperate with sockets located in a second end of said corner pillars, wherein said bosses are slid into the respective corner pillar sockets until the integrally formed spring tabs engage corresponding apertures formed in the corner pillar sockets, wherein a heavy duty enclosure can be shipped in a disassembled state and assembled on a desired site.

35. The heavy duty enclosure of claim 34 wherein said inner surface including a plurality of integrally formed pockets, each said pocket constructed and arranged to cooperate with a reinforcement beam extending between said at least two headers to provide increased weight capacity to said roof assembly.

36. A heavy duty injection molded utility enclosure comprising:

a symmetrical floor assembly for enclosing the bottom of said heavy duty enclosure;

four L-shaped corner pillars for providing strength and rigidity to said enclosure;

a pair of side wall assemblies for enclosing the left side and right side of said heavy duty enclosure;

a rear wall assembly for enclosing the back of said heavy duty enclosure;

a door assembly for enclosing and providing ingress into and egress from said heavy duty enclosure;

a roof assembly for enclosing the top of said heavy duty enclosure system, said roof assembly including at least two headers, a ridge cap assembly, and at least one pair of like-constructed roof panels, said like-constructed roof panels including an outer surface, an inner surface, a first locking edge, a second locking edge, a first closed edge opposite said first locking edge, and a second closed edge opposite said second locking edge wherein said first locking edge is constructed and arranged to cooperate with said first or said second edge of said ridge cap for weather resistant engagement, wherein said second locking edge is constructed and arranged to cooperate with a second locking edge of an adjacent roof panel for weather resistant engagement, wherein said inner surface is constructed and arranged with a means of attaching said roof panels to said wall panels, said means of attaching said roof panels to said wall panels including a plurality of sockets arranged in a linear fashion adjacent to said first closed edge, wherein each said socket is constructed and arranged to cooperate with a connector for attachment to a socket in at least one of said wall panel assemblies;

wherein a heavy duty enclosure can be shipped in a disassembled state and assembled on a desired site.

37. A heavy duty injection molded utility enclosure comprising:

a symmetrical floor assembly for enclosing the bottom of said heavy duty enclosure;

four L-shaped corner pillars for providing strength and rigidity to said enclosure;

a pair of side wall assemblies for enclosing the left side and right side of said heavy duty enclosure;

a rear wall assembly for enclosing the back of said heavy duty enclosure;

a door assembly for enclosing and providing ingress into and egress from said heavy duty enclosure;

a roof assembly for enclosing the top of said heavy duty enclosure system, said roof assembly including at least two headers, a ridge cap assembly, and at least one pair of like-constructed roof panels, each including an outer surface, an inner surface, a first locking edge, a second locking edge, a first closed edge opposite said first locking edge, and a second closed edge opposite said second locking edge, said roof panels including a plurality of spaced apart structural tubes extending through each roof panel between said outer surface and said inner surface extending between said first locking edge and said first closed edge, wherein at least one of said tubes is constructed and arranged as a socket within said first locking edge to for receiving at least one locking boss for attaching said like-configured roof panels to said ridge cap;

wherein a heavy duty enclosure can be shipped in a disassembled state and assembled on a desired site.

38. A heavy duty injection molded utility enclosure comprising:

a floor assembly for enclosing the bottom of said heavy duty enclosure;

four L-shaped corner pillars for providing strength and rigidity to said enclosure;

a pair of side wall assemblies for enclosing the left side and right side of said heavy duty enclosure, each of said side wall assemblies including at least one side wall panel member, wherein said ar least one wall panel member includes a first longitudinal end having an attachment means constructed and arranged to cooperate with a floor assembly or a roof assembly, a second longitudinal end having an attachment means constructed and arranged to cooperate with a floor assembly or a roof assembly, a first horizontal edge having an attachment means constructed and arranged to cooperate with a side wall panel member or a corner pillar member in an interlocking co-planar relationship and a second horizontal edge having an attachment means constructed and arranged to cooperate with a side wall panel member or a corner pillar member in an interlocking co-planar relationship, said first horizontal edge attachment means including at least one slot constructed and arranged for attachment of at least one T-connector, said at least one T-connector having a first end portion and a second end portion, wherein said first end portion of said at least one T-connector is inserted into and secured in place by said slot, wherein said second end portion of said at least one T-connector extends outwardly from said first horizontal edge for interlocking cooperation with an adjacent side wall panel or corner pillar resulting in a mechanically secure connection between said panels;

a rear wall assembly for enclosing the back of said heavy duty enclosure, said rear wall assembly including a pair of like-constructed rear wall panel members, said rear wall panel members having a first longitudinal end with an integral attachment means constructed and arranged to cooperate with a floor assembly or a roof assembly, a second longitudinal end having an attachment means constructed and arranged to cooperate with said roof or said floor assemblies, a first horizontal edge having an attachment means constructed and arranged to cooperate with a corner pillar member, a second horizontal edge constructed and arranged to cooperate with at least one panel member to provide a weather resistant seal, wherein said first horizontal edge attachment means includes a semi-circular conduit extending from about said first longitudinal end to about the middle portion of said edge, said conduit having a generally circular aperture for accepting a dowel centrally located within said middle portion end of said semi-circular conduit, wherein said semi-circular conduit is brought into an overlapping relationship with a corresponding semi-circular conduit and a dowel pin enters and extends between said circular apertures in each conduit resulting in a mechanically secure connection between the two said panels, said first horizontal edge attachment means including at least two C-shaped annular portions integrally formed at about said first and said second longitudinal ends of said first horizontal edge, a C-shaped annular portion formed in said semi-circular conduit at about said middle portion of said edge, each of said C-shaped annular portions adapted to cooperate in an interlocking manner with a hinge cap, each said hinge cap including an integrally formed C-shaped annular portion slidingly engagable into a corresponding annular portion, whereby said rear wall panels are attached to said interconnected floor panels, said corner pillars, and said roof panels by sliding each said rear wall panel horizontally into place over a plurality of hinge pins arranged to enter said annular portions and wherein said hinge caps are slidingly engaged to said C-shaped annular portions to close said each respective C-shaped annular portions to secure said panels to said hinge pins;

a door assembly for enclosing and providing ingress into and egress from said heavy duty enclosure;

a roof assembly for enclosing the top of said heavy duty enclosure system;

wherein a heavy duty enclosure can be shipped in a disassembled state and assembled on a desired site.

39. A heavy duty injection molded utility enclosure comprising:

a floor assembly for enclosing the bottom of said heavy duty enclosure;

four L-shaped corner pillars for providing strength and rigidity to said enclosure;

a pair of side wall assemblies for enclosing the left side and right side of said heavy duty enclosure, each of said side wall assemblies including at least one side wall panel member, wherein said at least one wall panel member includes a first longitudinal end having an attachment means constructed and arranged to cooperate with a floor assembly or a roof assembly, a second longitudinal end having an attachment means constructed and arranged to cooperate with a floor assembly or a roof assembly, a first horizontal edge having an attachment means constructed and arranged to cooperate with a side wall panel member or a corner pillar member in an interlocking co-planar relationship and a second horizontal edge having an attachment means constructed and arranged to cooperate with a side wall panel member or a corner pillar member in an interlocking co-planar relationship, said first horizontal edge attachment means including at least one slot constructed and arranged for attachment of at least one T-connector, said at least one T-connector having a first end portion and a second end portion, wherein said first end portion of said at least one T-connector is inserted into and secured in place by said slot, wherein said second end portion of said at least one T-connector extends outwardly from said first horizontal edge for interlocking cooperation with an adjacent side wall panel or corner pillar resulting in a mechanically secure connection between said panels;

a rear wall assembly for enclosing the back of said heavy duty enclosure;

a door assembly for enclosing and providing ingress into and egress from said heavy duty enclosure;

a roof assembly for enclosing the top of said heavy duty enclosure system, wherein said roof assembly includes at least two headers, a ridge cap assembly, and two pair of like-constructed roof panels, said at least two headers include an outer surface, an inner surface, an upper vented surface, and a lower surface, wherein said lower surface includes a plurality of outwardly extending bosses constructed and arranged to cooperate with sockets located in a second end of said corner pillars, wherein said bosses are slid into the respective corner pillar sockets until the integrally formed spring tabs engage corresponding apertures formed in the corner pillar sockets;

wherein a heavy duty enclosure can be shipped in a disassembled state and assembled on a desired site.

40. A heavy duty injection molded utility enclosure comprising:

a floor assembly for enclosing the bottom of said heavy duty enclosure;

four L-shaped corner pillars for providing strength and rigidity to said enclosure;

a pair of side wall assemblies for enclosing the left side and right side of said heavy duty enclosure, each of said side wall assemblies including at least one side wall panel member, wherein said at least one wall panel member includes a first longitudinal end having an attachment means constructed and arranged to cooperate with a floor assembly or a roof assembly, a second longitudinal end having an attachment means constructed and arranged to cooperate with a floor assembly or a roof assembly, a first horizontal edge having an attachment means constructed and arranged to cooperate with a side wall panel member or a corner pillar member in an interlocking co-planar relationship and a second horizontal edge having an attachment means constructed and arranged to cooperate with a side wall panel member or a corner pillar member in an interlocking co-planar relationship, said first horizontal edge attachment means including at least one slot constructed and arranged for attachment of at least one T-connector, said at least one T-connector having a first end portion and a second end portion, wherein said first end portion of said at least one T-connector is inserted into and secured in place by said slot, wherein said second end portion of said at least one T-connector extends outwardly from said first horizontal edge for interlocking cooperation with an adjacent side wall panel or corner pillar resulting in a mechanically secure connection between said panels;

a rear wall assembly for enclosing the back of said heavy duty enclosure;

a door assembly for enclosing and providing ingress into and egress from said heavy duty enclosure;

a roof assembly for enclosing the top of said heavy duty enclosure system, said roof assembly including at least two headers, a ridge cap assembly, and two pair of like-constructed roof panels, said like-constructed roof panels including an outer surface, an inner surface, a first locking edge, a second locking edge, a first closed edge opposite said first locking edge, and a second closed edge opposite said second locking edge wherein said first locking edge is constructed and arranged to cooperate with said first or said second edge of said ridge cap for weather resistant engagement, wherein said second locking edge is constructed and arranged to cooperate with a second locking edge of an adjacent roof panel for weather resistant engagement, wherein said inner surface is constructed and arranged with a means of attaching said roof panels to said wall panels, said means of attaching said roof panels to said wall panels including a plurality of sockets arranged in a linear fashion adjacent to said first closed edge, wherein each said socket is constructed and arranged to cooperate with a connector for attachment to a corresponding socket in an upper edge of said wall panel assemblies;

wherein a heavy duty enclosure can be shipped in a disassembled state and assembled on a desired site.

41. A heavy duty injection molded utility enclosure comprising:

a floor assembly for enclosing the bottom of said heavy duty enclosure;

four L-shaped corner pillars for providing strength and rigidity to said enclosure;

a pair of side wall assemblies for enclosing the left side and right side of said heavy duty enclosure, each of said side wall assemblies including at least one side wall panel member, wherein said at least one wall panel member includes a first longitudinal end having an attachment means constructed and arranged to cooperate with a floor assembly or a roof assembly, a second longitudinal end having an attachment means constructed and arranged to cooperate with a floor assembly or a roof assembly, a first horizontal edge having an attachment means constructed and arranged to cooperate with a side wall panel member or a corner pillar member in an interlocking co-planar relationship and a second horizontal edge having an attachment means constructed and arranged to cooperate with a side wall panel member or a corner pillar member in an interlocking co-planar relationship, said first horizontal edge attachment means including at least one slot constructed and arranged for attachment of at least one T-connector, said at least one T-connector having a first end portion and a second end portion, wherein said first end portion of said at least one T-connector is inserted into and secured in place by said slot, wherein said second end portion of said at least one T-connector extends outwardly from said first horizontal edge for interlocking cooperation with an adjacent side wall panel or corner pillar resulting in a mechanically secure connection between said panels;

a rear wall assembly for enclosing the back of said heavy duty enclosure;

a door assembly for enclosing and providing ingress into and egress from said heavy duty enclosure;

a roof assembly for enclosing the top of said heavy duty enclosure system, said roof assembly including at least two headers, a ridge cap assembly, and two pair of like-constructed roof panels, said like-constructed roof panels including an outer surface, an inner surface, a first locking edge, a second locking edge, a first closed edge opposite said first locking edge, and a second closed edge opposite said second locking edge wherein said first locking edge is constructed and arranged to cooperate with said first or said second edge of said ridge cap for weather resistant engagement, wherein said second locking edge is constructed and arranged to cooperate with a second locking edge of an adjacent roof panel for weather resistant engagement, wherein said inner surface is constructed and arranged with a means of attaching said roof panels to said wall panels, said roof panels including a plurality of spaced apart structural tubes extending through each roof panel between said outer surface and said inner surface extending between said first locking edge and said first closed edge, wherein at least one of said tubes is constructed and arranged as a socket within said first locking edge to for receiving at least one locking boss for attaching said like-configured roof panels to said ridge cap;

wherein a heavy duty enclosure can be shipped in a disassembled state and assembled on a desired site.

42. A heavy duty injection molded utility enclosure comprising:

a floor assembly for enclosing the bottom of said heavy duty enclosure;

four L-shaped corner pillars for providing strength and rigidity to said enclosure;

a pair of side wall assemblies for enclosing the left side and right side of said heavy duty enclosure, each of said side wall assemblies including at least one side wall panel member, wherein said at least one wall panel member includes a first longitudinal end having an attachment means constructed and arranged to cooperate with a floor assembly or a roof assembly, a second longitudinal end having an attachment means constructed and arranged to cooperate with a floor assembly or a roof assembly, a first horizontal edge having an attachment means constructed and arranged to cooperate with a side wall panel member or a corner pillar member in an interlocking coplanar relationship and a second horizontal edge having an attachment means constructed and arranged to cooperate with a side wall panel member or a corner pillar member in an interlocking co-planar relationship, said first horizontal edge attachment means including at least one slot constructed and arranged for attachment of at least one T-connector, said at least one T-connector having a first end portion and a second end portion, wherein said first end portion of said at least one T-connector is inserted into and secured in place by said slot, wherein said second end portion of said at least one T-connector extends outwardly from said first horizontal edge for interlocking cooperation with an adjacent side wall panel or corner pillar resulting in a mechanically secure connection between said panels;

a rear wall assembly for enclosing the back of said heavy duty enclosure;

a door assembly for enclosing and providing ingress into and egress from said heavy duty enclosure, said door assembly including a pair of like-constructed door panels each having a first longitudinal end including at least one integrally formed socket, means, a second longitudinal end including an integrally formed hinge means, a first horizontal edge having a semi-circular conduit extending from about said first longitudinal end to about the middle portion of said edge said conduit having an integrally formed hinge means, a second horizontal edge being generally flat;

a roof assembly for enclosing the top of said heavy duty enclosure system;

wherein a heavy duty enclosure can be shipped in a disassembled state and assembled on a desired site.

43. The heavy duty enclosure system of claim 42 wherein said hinge means includes a C-shaped annular portion for accepting a hinge pin, said C-shaped annular portion constructed and arranged to cooperate with a hinge clip to close said annular portion and allow pivoting movement of said door panels;

wherein said C-shaped hinge means allows said door panels to be assembled to said enclosure without partial disassembly of other portions of said enclosure.

* * * * *